US009364942B2

(12) United States Patent
Puzio et al.

(10) Patent No.: US 9,364,942 B2
(45) Date of Patent: Jun. 14, 2016

(54) QUICK RELEASE SOCKET ATTACHMENT FOR IMPACT WRENCH

(75) Inventors: Daniel Puzio, Baltimore, MD (US); Robert J. Opsitos, Felton, PA (US); Robert G. Kusmierski, York, PA (US); Robert S. Gehret, Hampstead, MD (US); John Cox, Lutherville, MD (US); Craig A. Schell, Baltimore, MD (US); Michael Haupt, Abington, MD (US); Joseph Kelleher, Bowie, MD (US)

(73) Assignee: BLACK & DECKER INC., New Britain, CT (US)

( * ) Notice: Subject to any disclaimer, the term of this patent is extended or adjusted under 35 U.S.C. 154(b) by 932 days.

(21) Appl. No.: 13/494,325

(22) Filed: Jun. 12, 2012

(65) Prior Publication Data

US 2012/0325509 A1 Dec. 27, 2012

Related U.S. Application Data

(60) Provisional application No. 61/500,872, filed on Jun. 24, 2011.

(51) Int. Cl.
*B25B 23/00* (2006.01)
*B25B 21/02* (2006.01)

(52) U.S. Cl.
CPC ..... *B25B 21/02* (2013.01); *B25B 23/0035* (2013.01)

(58) Field of Classification Search
CPC ..... B25B 23/0035; Y10T 3/599
USPC ..... 81/177.85; 403/325, 322.4, 330
See application file for complete search history.

(56) References Cited

U.S. PATENT DOCUMENTS

| | | | | |
|---|---|---|---|---|
| 3,172,675 | A * | 3/1965 | Gonzalez | 279/2.23 |
| 3,924,493 | A * | 12/1975 | Penner | 81/177.85 |
| 4,258,597 | A | 3/1981 | Gelman | |
| 4,285,254 | A | 8/1981 | Romeo | |
| 4,491,043 | A | 1/1985 | Dempsey et al. | |
| 4,768,405 | A * | 9/1988 | Nickipuck | B25B 15/001 403/325 |
| 5,050,467 | A * | 9/1991 | Brown et al. | 81/466 |
| 5,526,460 | A | 6/1996 | DeFrancesco et al. | |
| 5,637,101 | A | 6/1997 | Shillington | |
| 6,062,112 | A * | 5/2000 | Bonniot | 81/177.85 |
| 6,672,183 | B2 * | 1/2004 | Johnson | 81/466 |
| 6,851,341 | B2 * | 2/2005 | Iwinski et al. | 81/177.85 |
| 6,883,402 | B2 | 4/2005 | Cerda | |
| 6,889,582 | B2 * | 5/2005 | Wilhelm | 81/177.85 |
| 6,938,526 | B2 | 9/2005 | Milbourne et al. | |

(Continued)

FOREIGN PATENT DOCUMENTS

EP 2537639 A1 6/2012

OTHER PUBLICATIONS

Majerus, Hubert—European Search Report—Jun. 10, 2014—6 pages—The Hague.

*Primary Examiner* — Andrew M Tecco
(74) *Attorney, Agent, or Firm* — Scott B. Markow

(57) ABSTRACT

An impact wrench, includes a housing including a handle. A rotating anvil is supported by the housing and includes a polygonal head adapted for receiving a socket thereon. A socket retention device is mounted to the polygonal head of the rotating anvil for securing a socket to the polygonal head. A socket release mechanism includes an actuator mounted to the housing and operable to disengage the socket retention device from the socket to allow the socket to be removed from the anvil.

20 Claims, 50 Drawing Sheets

(56) References Cited

U.S. PATENT DOCUMENTS

| | | | | |
|---|---|---|---|---|
| 7,240,590 | B1 | 7/2007 | Lin | |
| 7,249,638 | B2 | 7/2007 | Bodine et al. | |
| 2002/0152848 | A1* | 10/2002 | Johnson | 81/465 |
| 2007/0186729 | A1 | 8/2007 | Baker | |
| 2009/0001722 | A1 | 1/2009 | Yoshihiro et al. | |
| 2010/0058896 | A1 | 3/2010 | Abel et al. | |

* cited by examiner

QUICK RELEASE SOCKET ATTACHMENT FOR IMPACT WRENCH

CROSS-REFERENCE TO RELATED APPLICATIONS

This application claims the benefit of U.S. Provisional Application No. 61/500,872, filed on Jun. 24, 2011. The entire disclosure of the above application is incorporated herein by reference.

FIELD

The present disclosure relates to impact wrenches and more particularly, to a quick release socket attachment for an impact wrench or other similar power or hand drive tools having a drive attachment connected to a polygonal interface.

BACKGROUND

This section provides background information related to the present disclosure which is not necessarily prior art.

An impact wrench is a power tool designed to drive a socket wrench and to deliver a high torque output with minimal exertion by the user, by storing energy in a rotating mass, then delivering it suddenly to the output shaft. Impact wrenches are commonly powered by compressed air as well as electric or hydraulic power, with cordless, battery powered devices becoming increasingly popular in recent times. Impact wrenches are widely used in many industries, such as automotive repair, equipment maintenance, product assembly and any other instance where a high torque output is needed.

In operation, a rotating mass is accelerated by a motor, storing energy, and is then suddenly connected to a rotating anvil, creating a high-torque impact. The hammer mechanism is designed such that after delivering the impact, the hammer is allowed to spin freely. With this design, the only reaction force applied to the body of the tool is the motor accelerating the hammer. Therefore, the operator feels very little torque, even though a very high peak torque is delivered to the socket.

Existing socket retention features are used to connect a socket to a square drive socket of the anvil. However, these socket retention features can be frustrating to the user. Hog ring-type retention features have been used but don't always retain the socket to the anvil. Pin-type retention features retain the socket but also require the user to use a pointed tool to release the socket. Accordingly, existing socket retention features can be frustrating to the user.

SUMMARY

This section provides a general summary of the disclosure, and is not a comprehensive disclosure of its full scope or all of its features.

A power tool, includes a housing including a handle. A rotating shaft is supported by the housing and includes a polygonal head adapted for receiving a socket thereon. A socket retention device is mounted to the polygonal head of the rotating shaft for securing a socket to the polygonal head. A socket release mechanism includes an actuator mounted to the housing and is operable to disengage the socket retention device from the socket to allow the socket to be removed from the shaft. The actuator can include a push button, a slide button, an electro-mechanical actuator, an actuating collar, a slider tab or other actuating device mounted to the housing.

According to an alternative embodiment, the actuator includes a push button mounted to said rotating shaft.

The socket retention device can include a retainer pin and the socket release mechanism can include a lever pin disposed within a central cavity of the rotating shaft. The lever pin can include a semi-spherical pivot or can include a pin and slot arrangement, a pin and hole arrangement or a lever and pivot pin arrangement. The lever pin can be biased by an integral spring or a separate spring member.

Alternatively, the socket retention device can include a ball actuated by a slidable or rotary cam collar or by a cam pin.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 13:
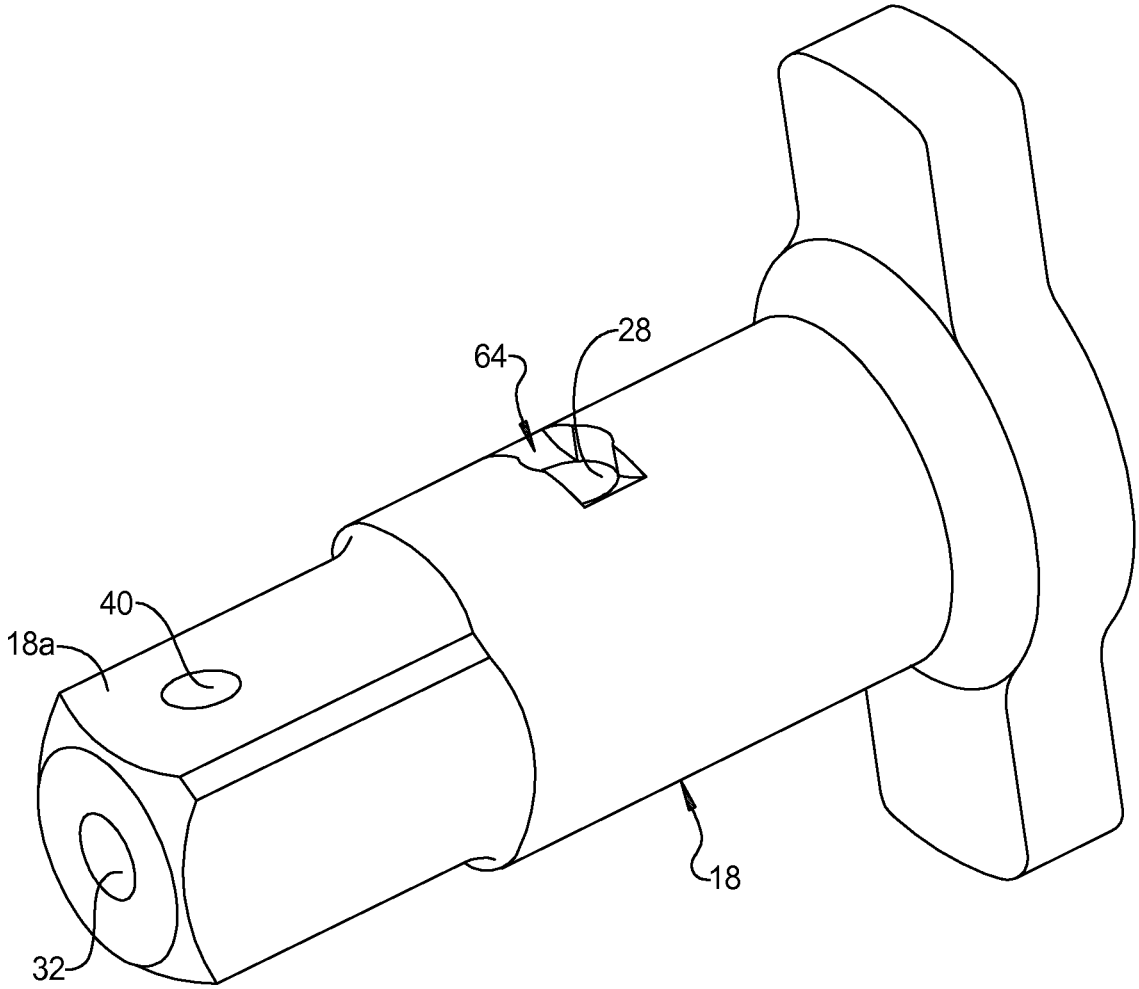
FIG. 13 is a perspective view of the anvil shaft of the push button socket release mechanism of FIG. 10.
Figure 13A:
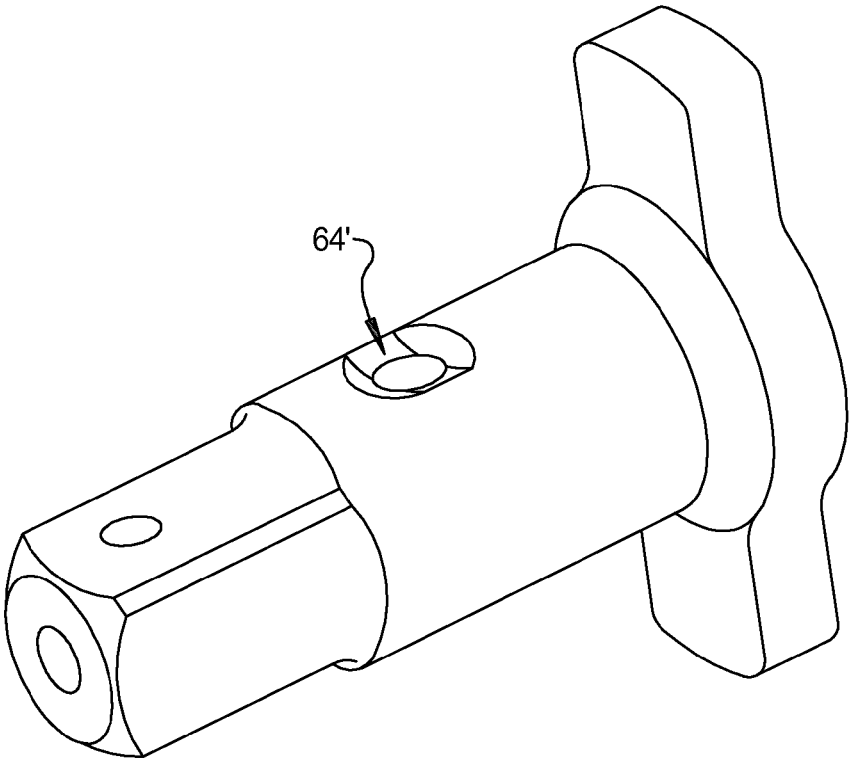
Figure 13B:
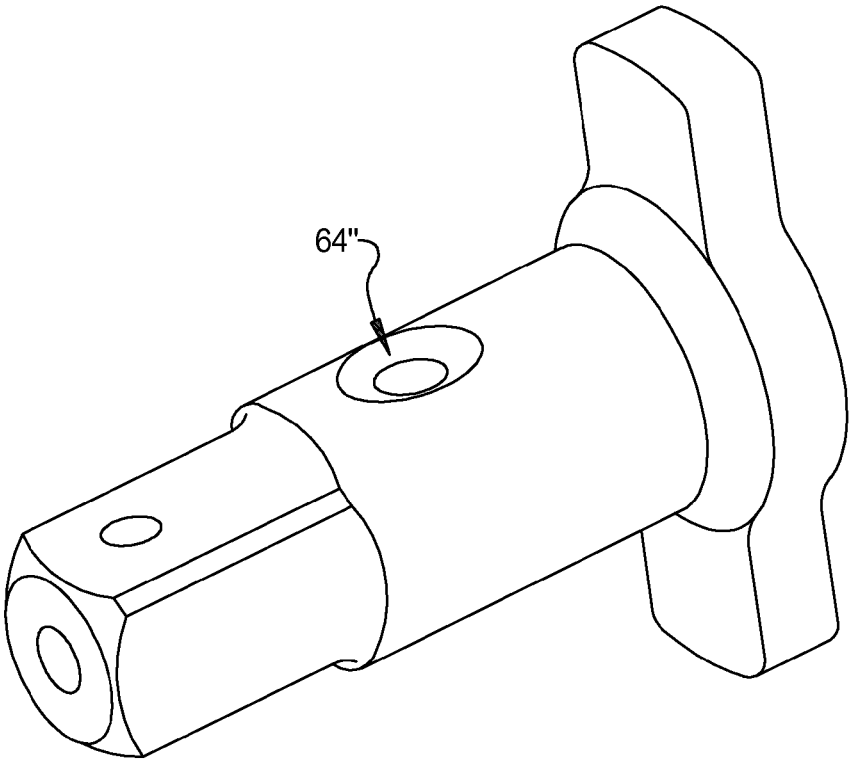
Figure 14:
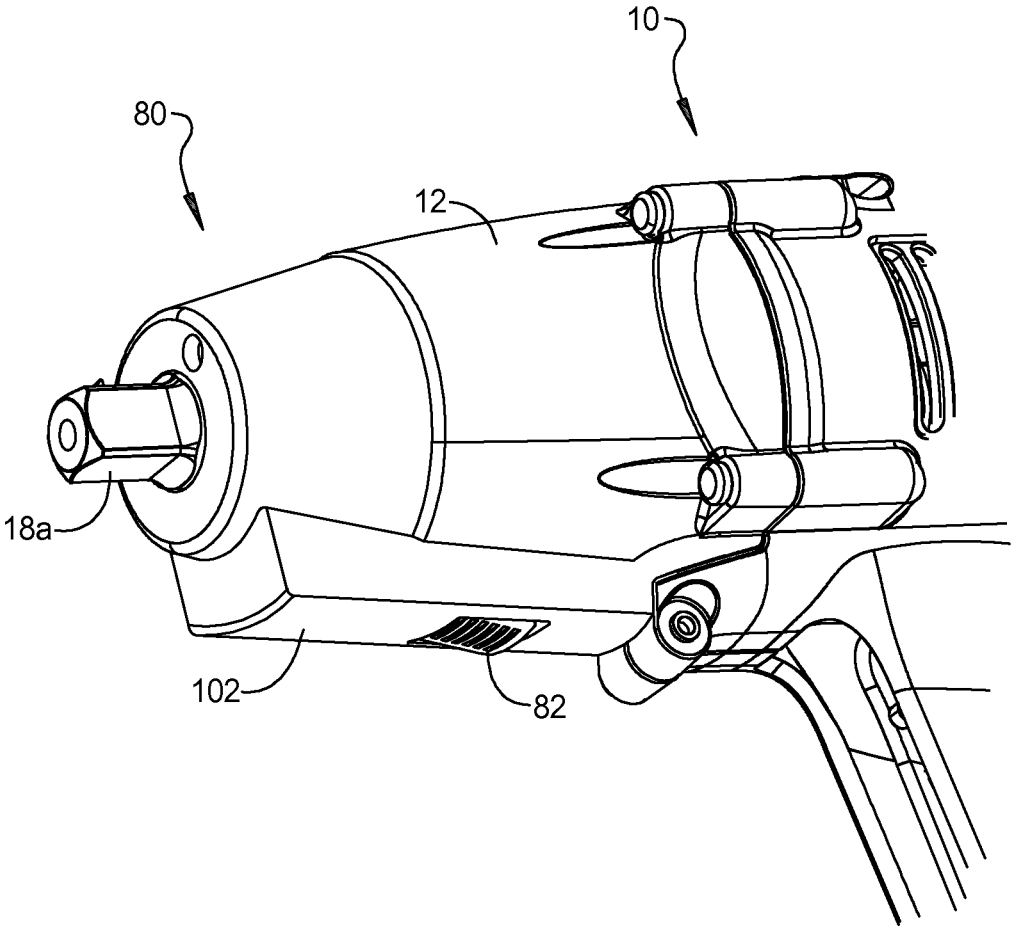
Figure 15:
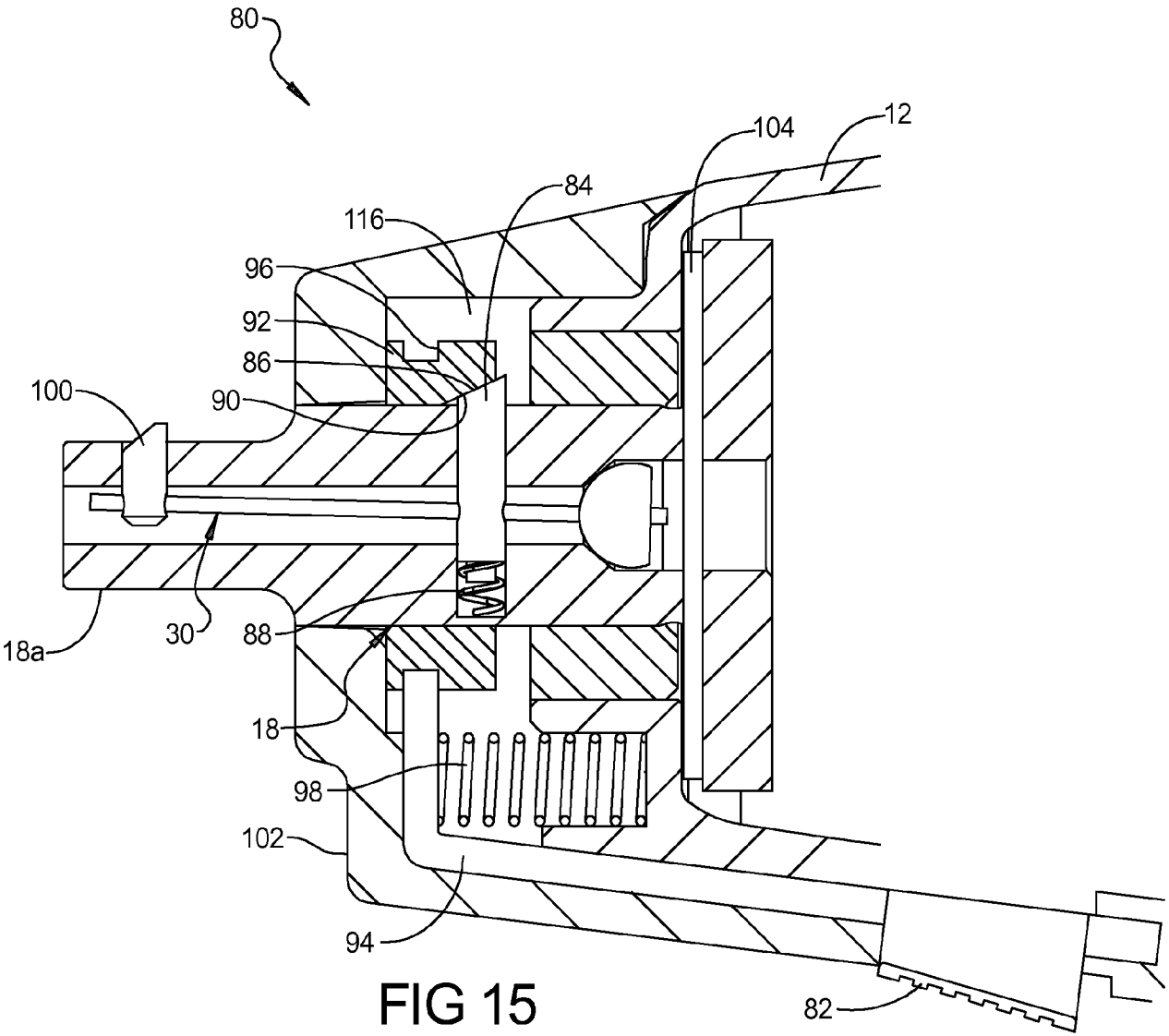
Figure 16:
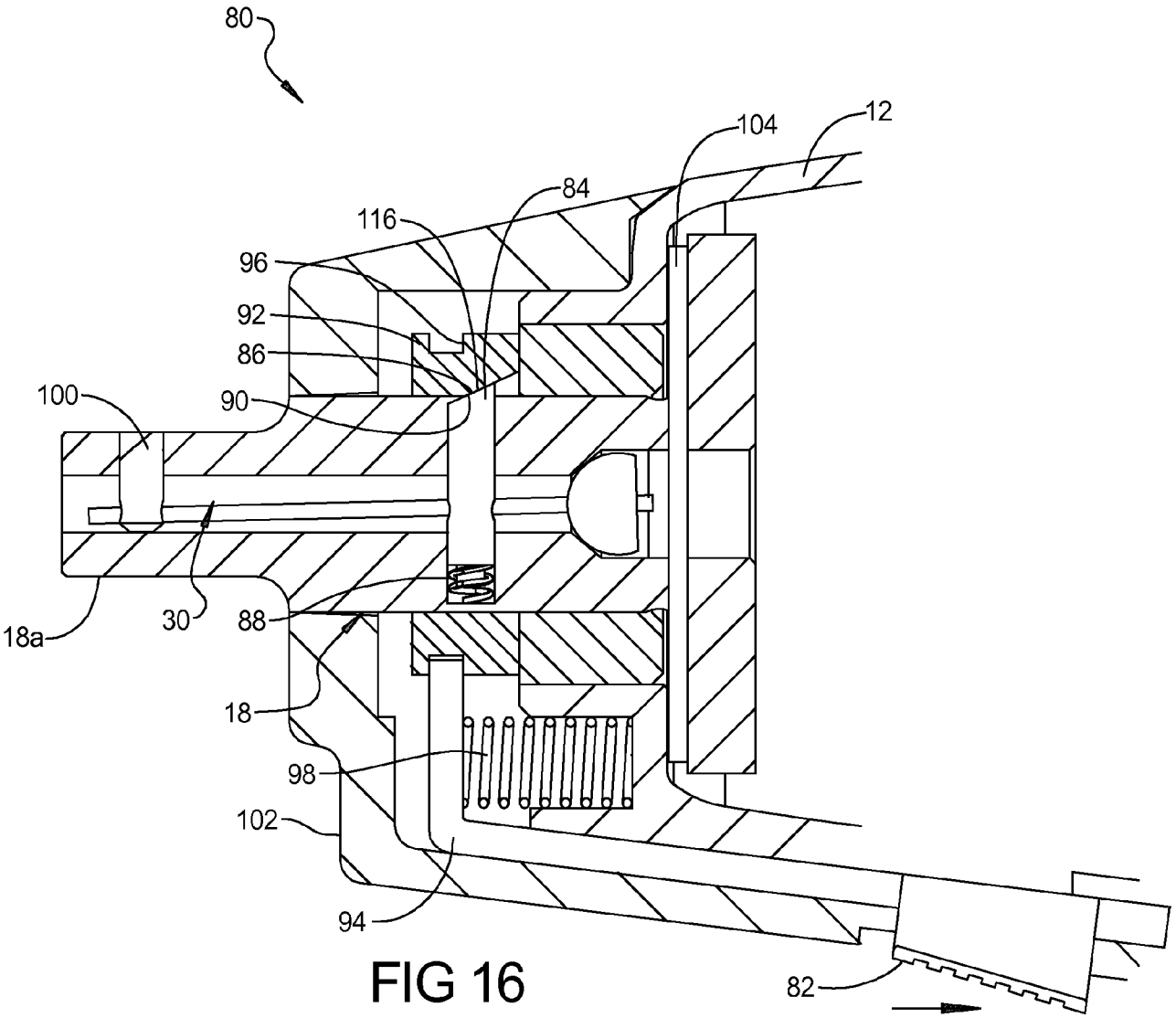
Figure 17:
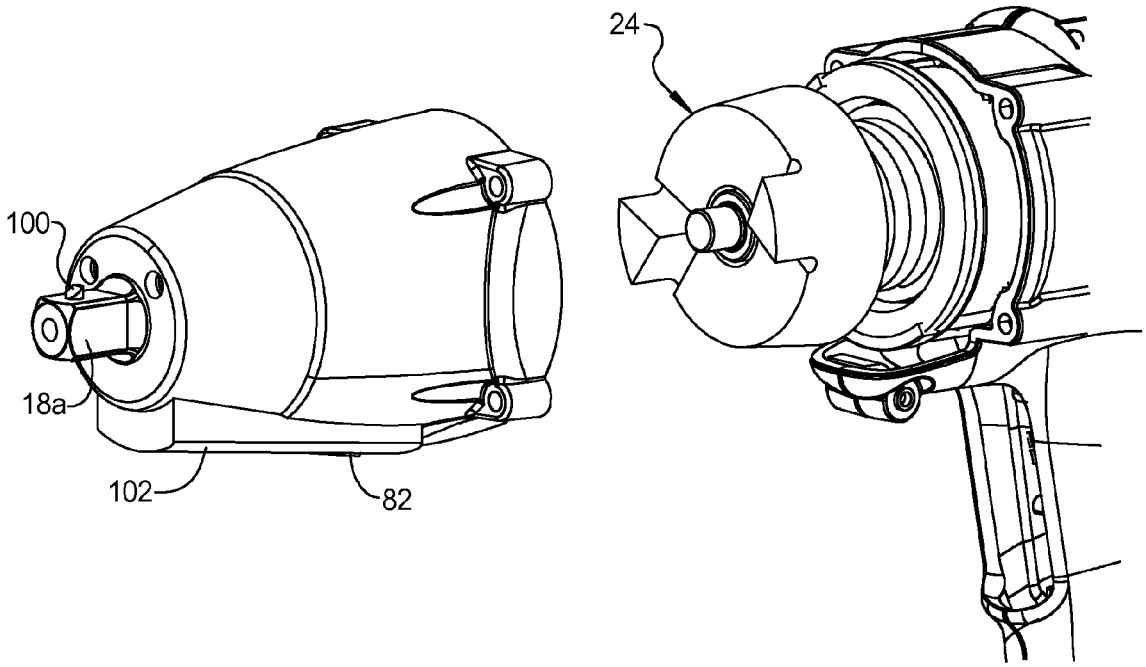
Figure 18:
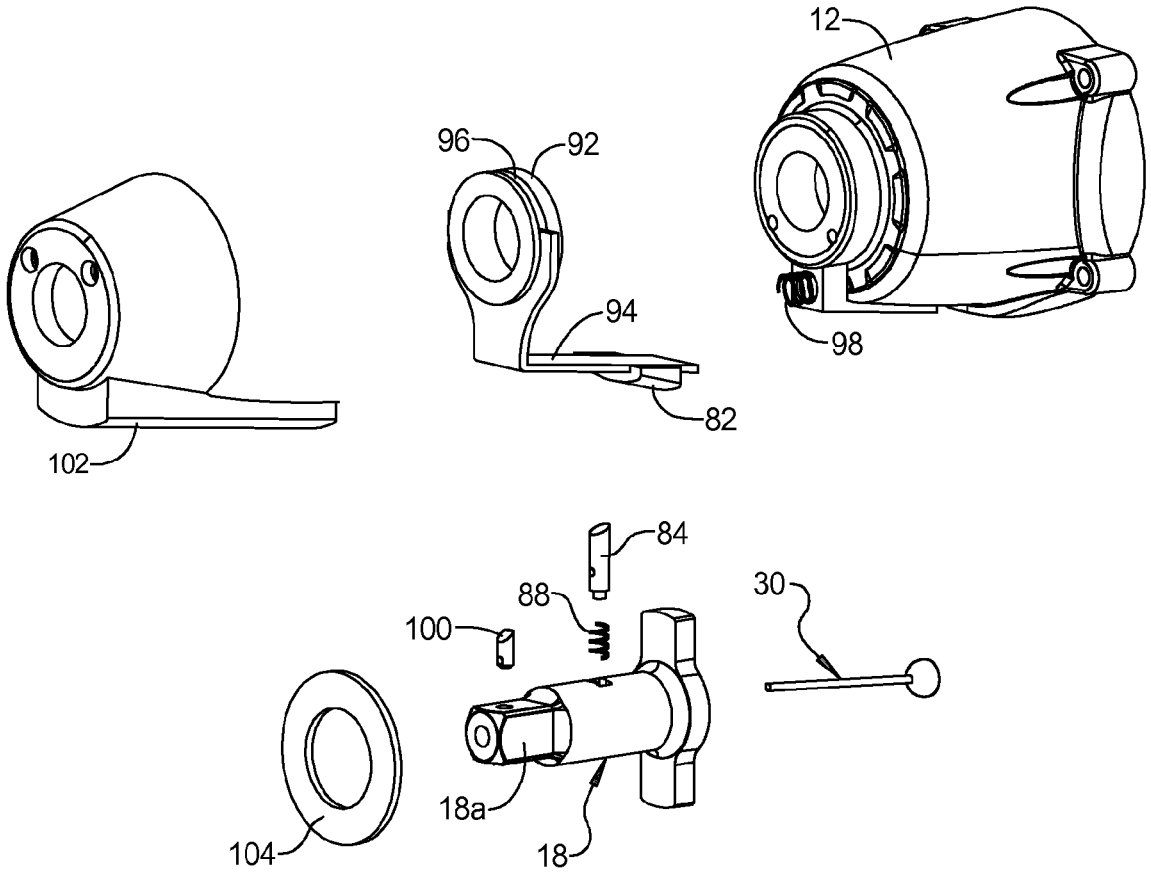
Figure 19:
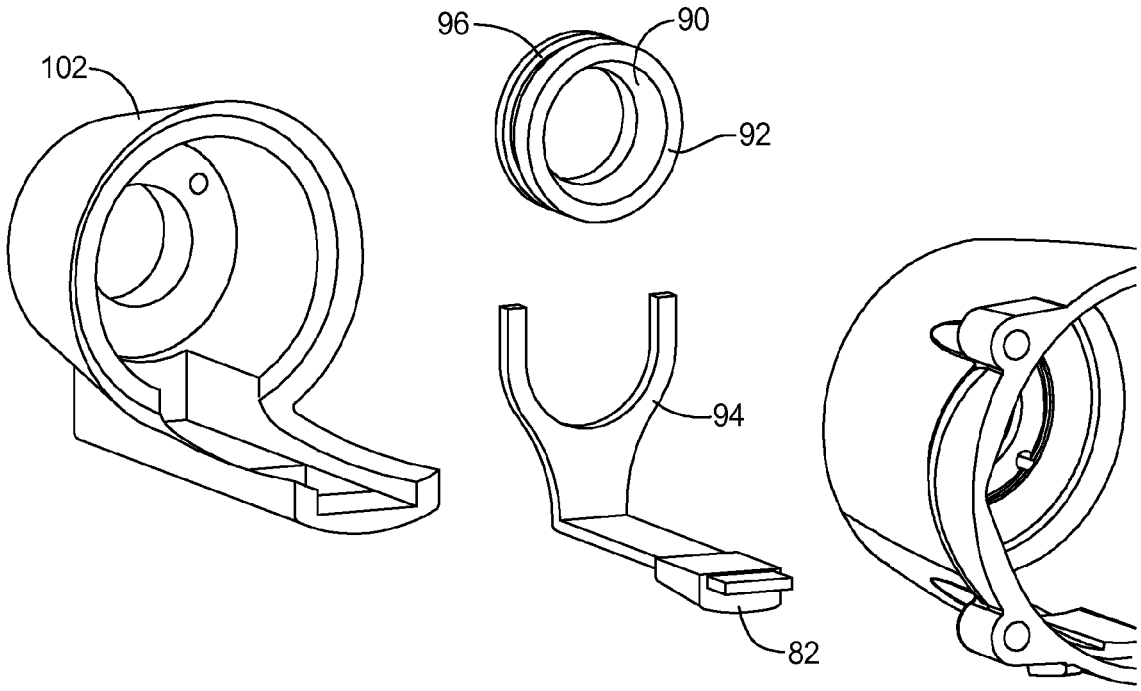
Figure 20:
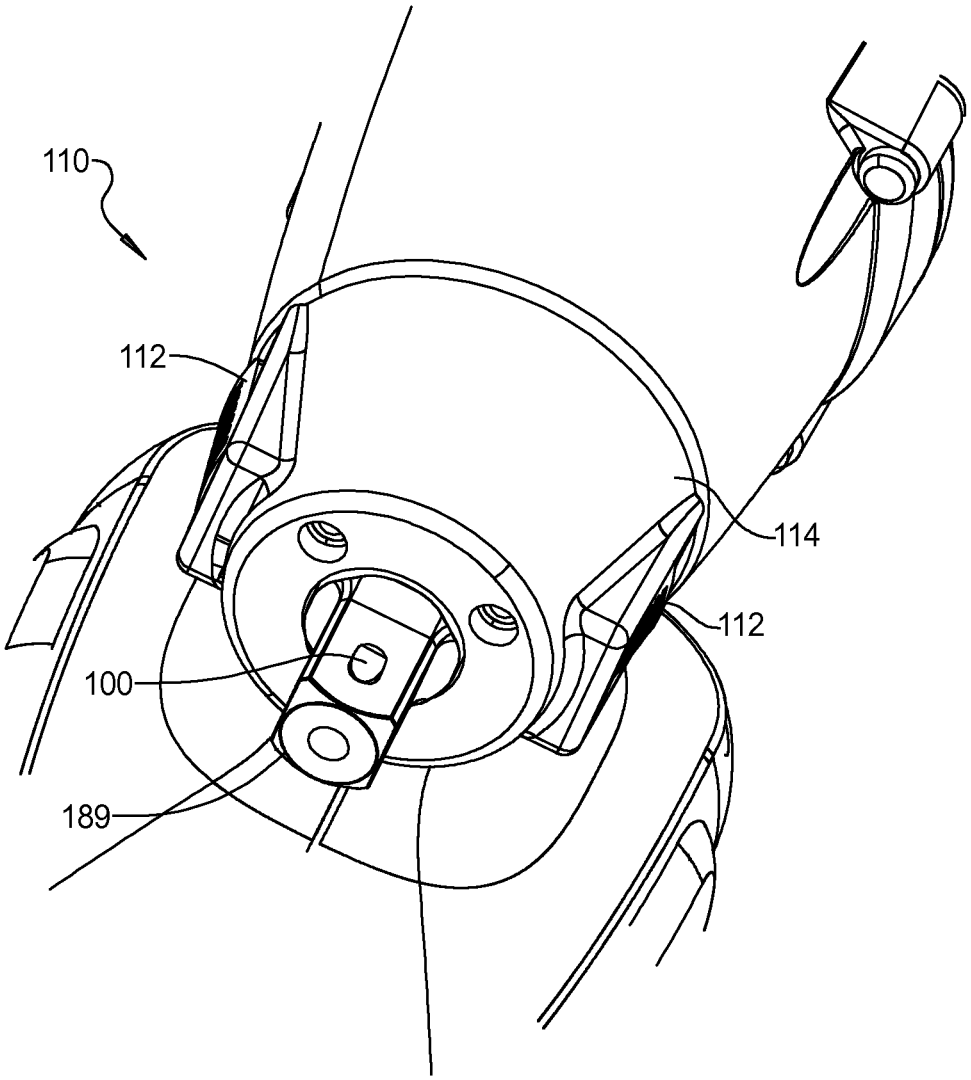
Figure 21A:
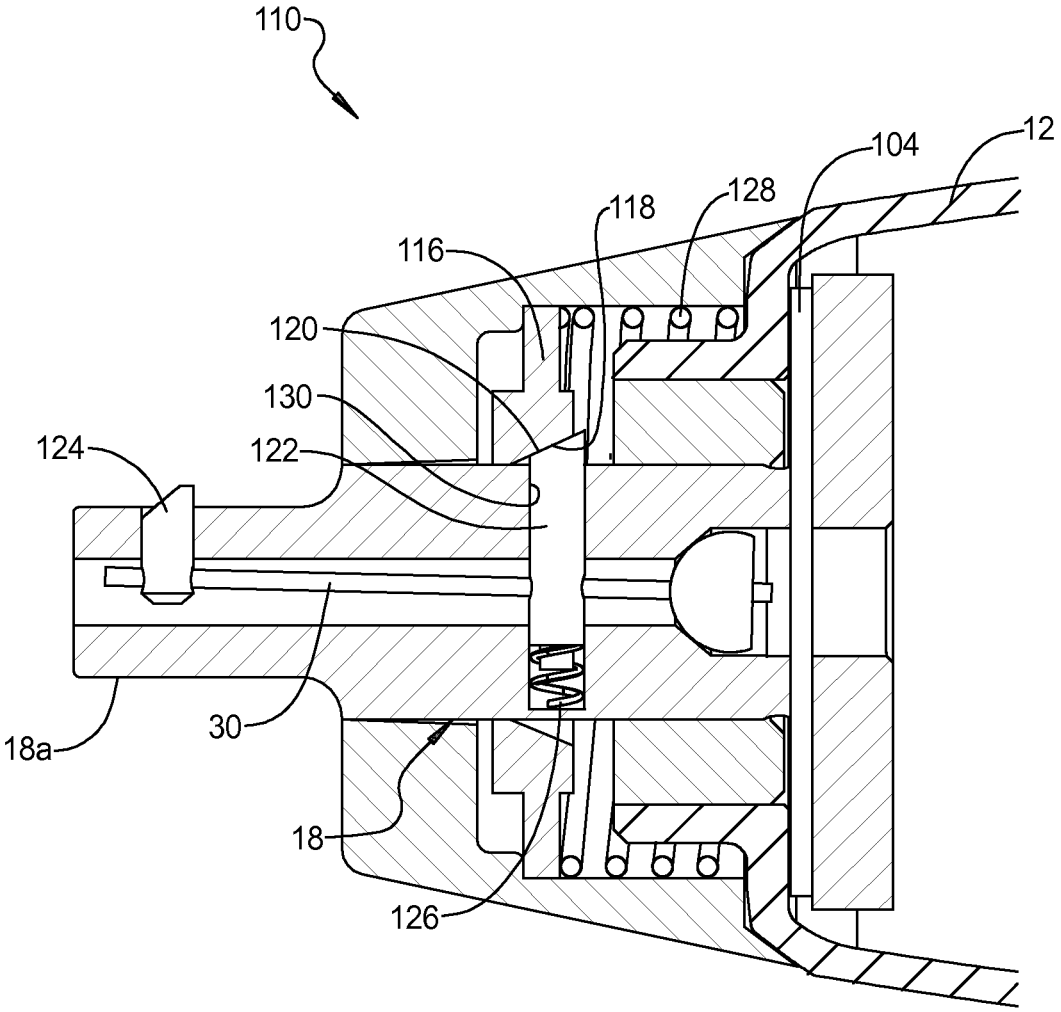
Figure 21B:
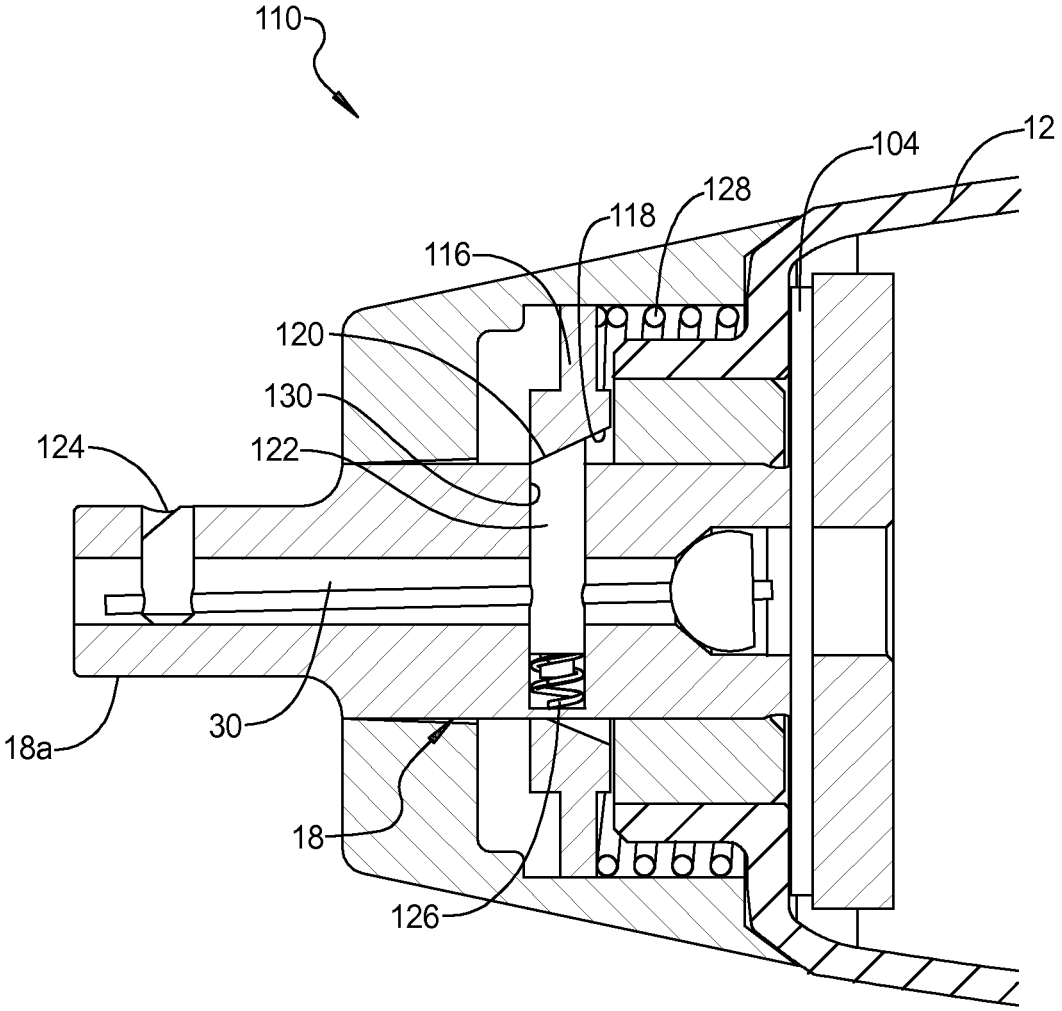
Figure 22:
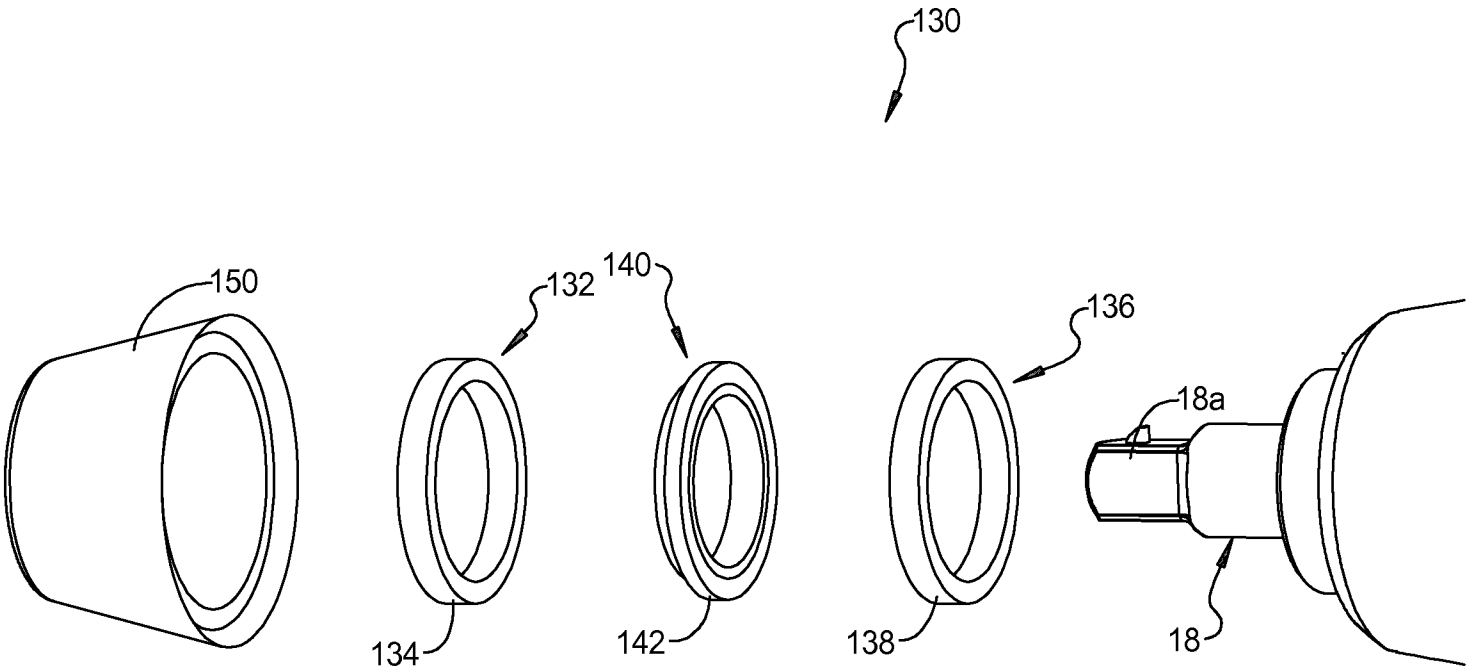
Figure 23:
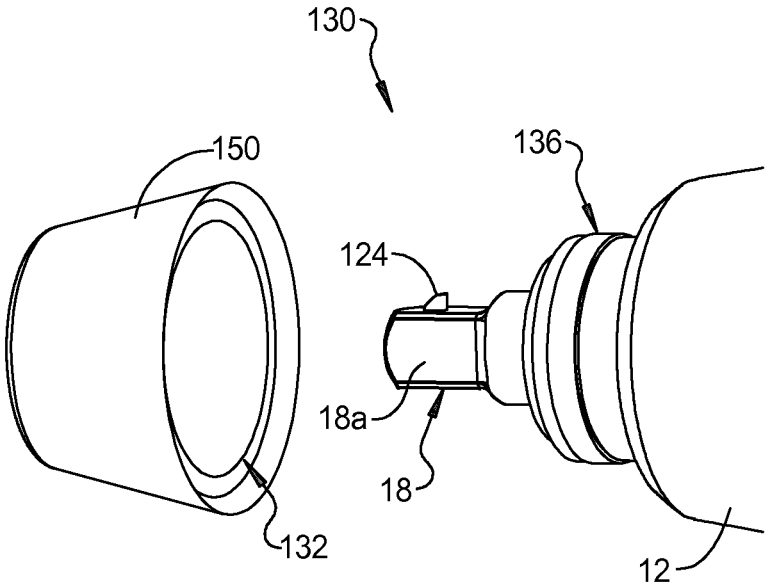
Figure 24:
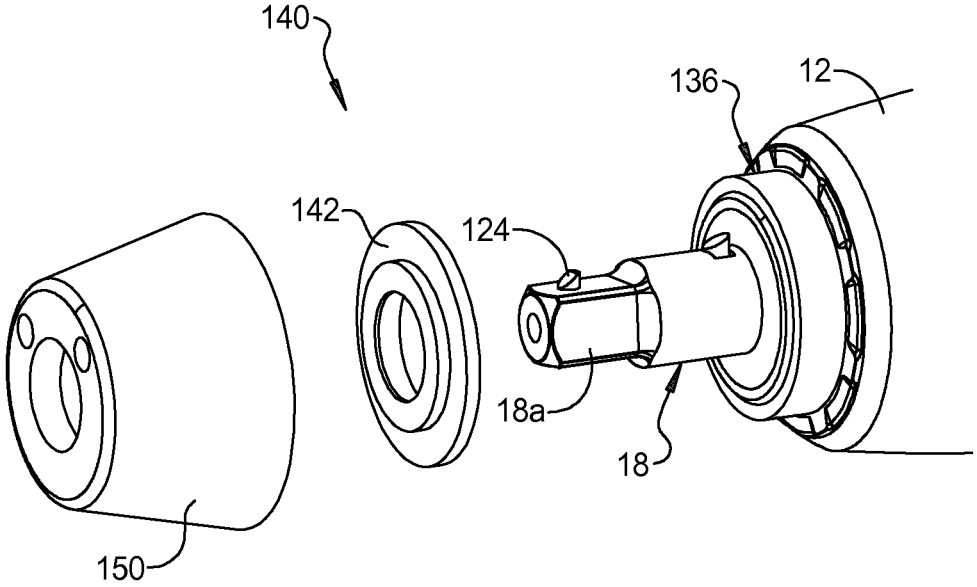
Figure 25A:
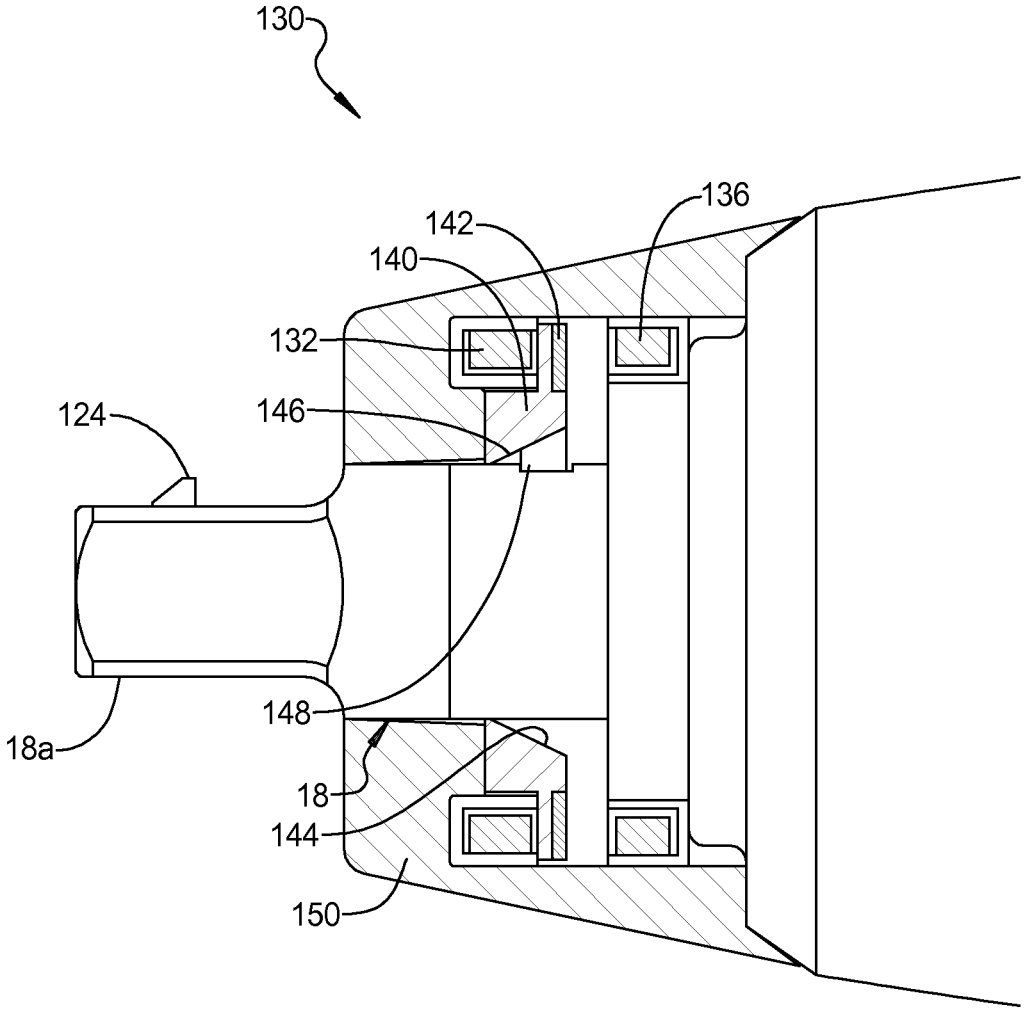
Figure 25B:
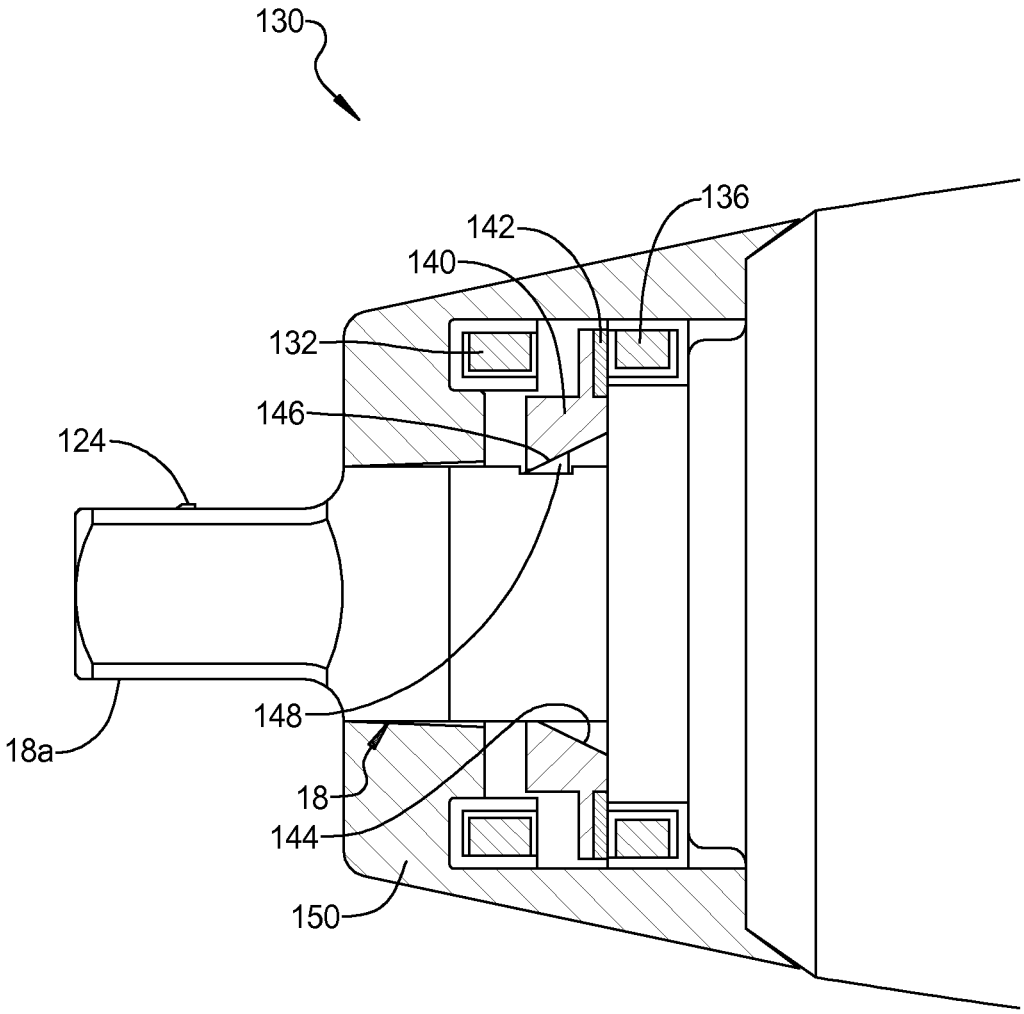
Figure 26:
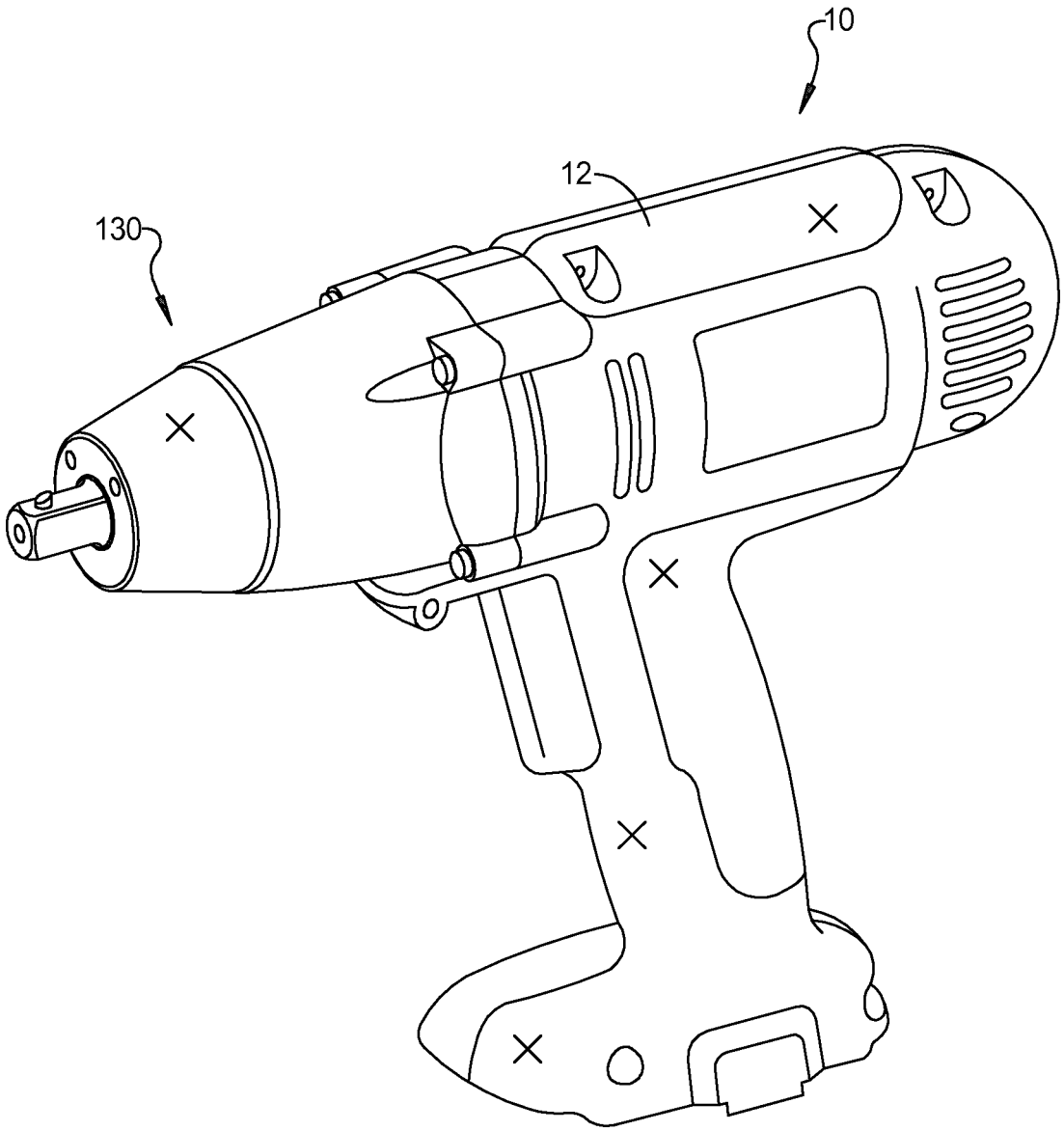
Figure 27:
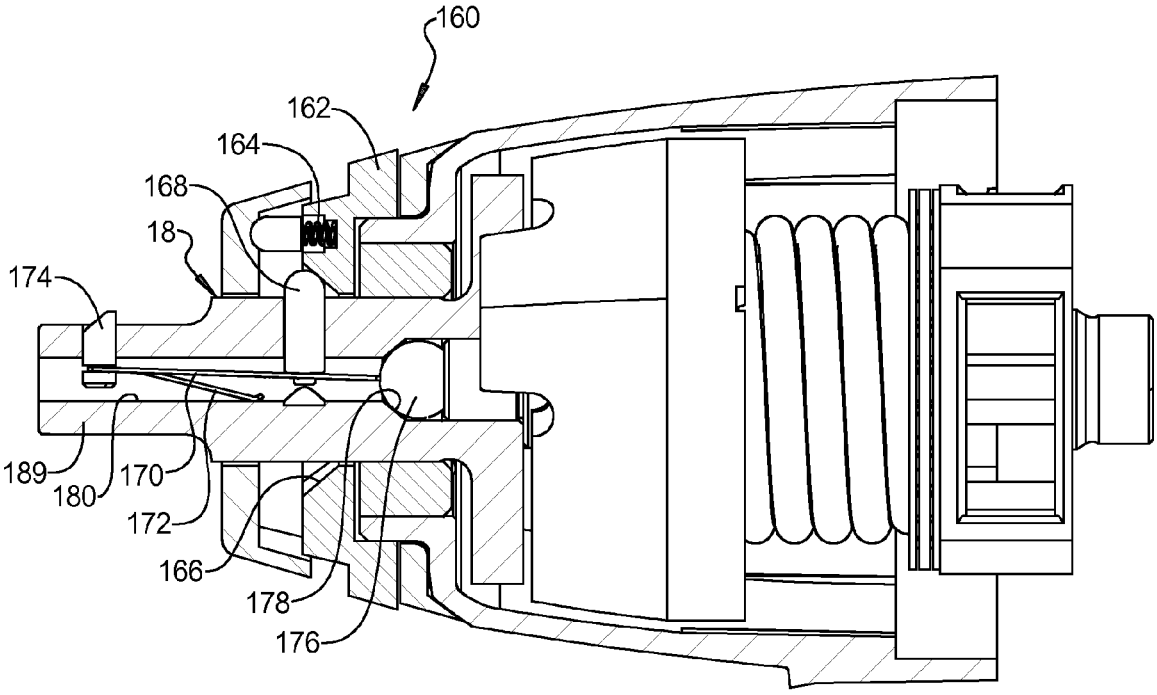
Figure 28:
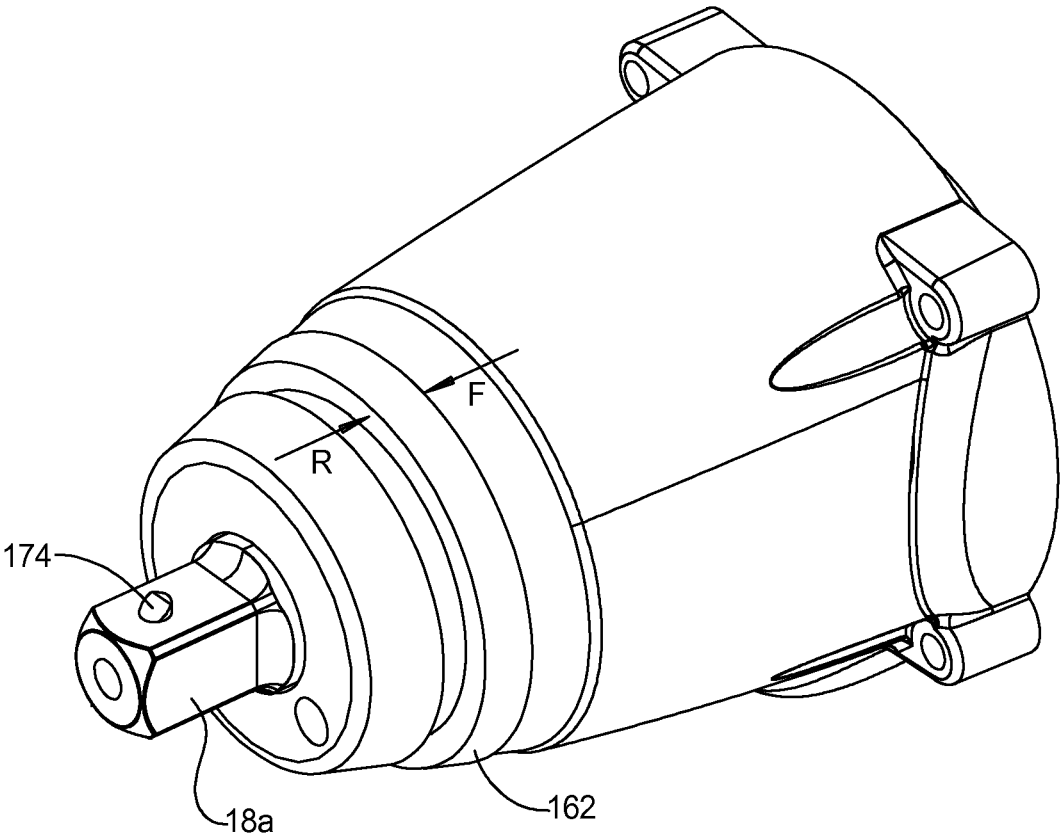
Figure 29:
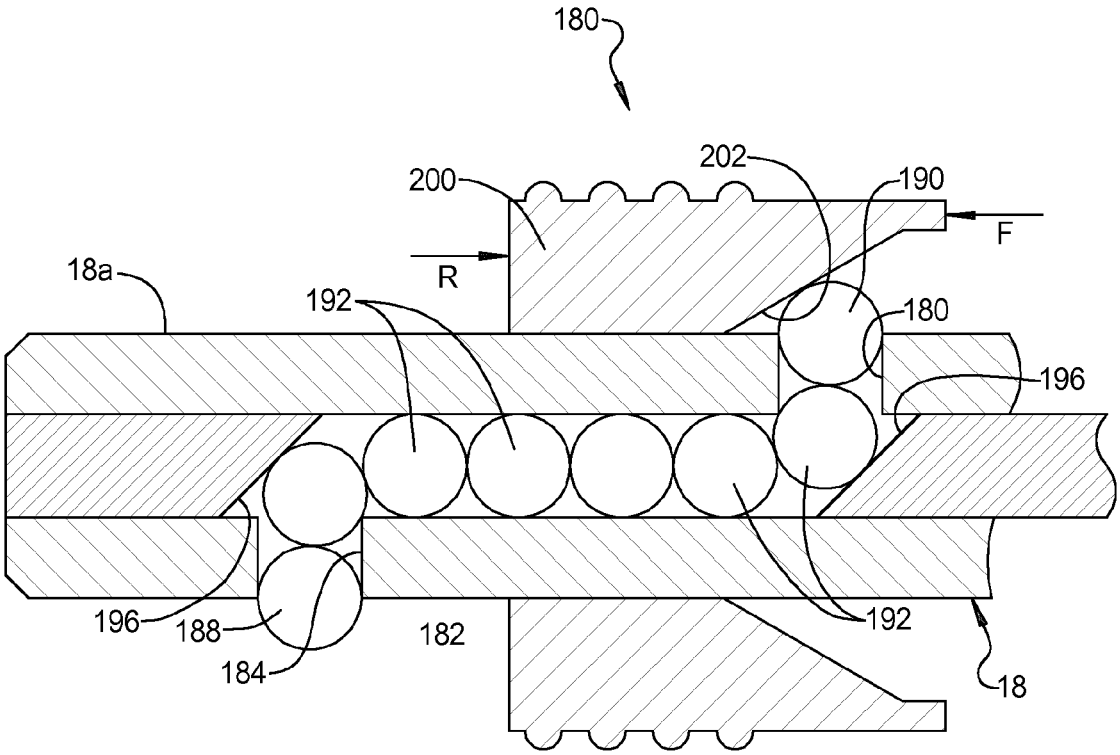
Figure 30:
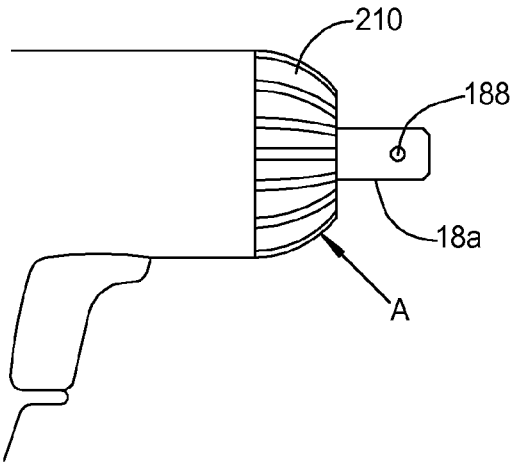
Figure 31A:
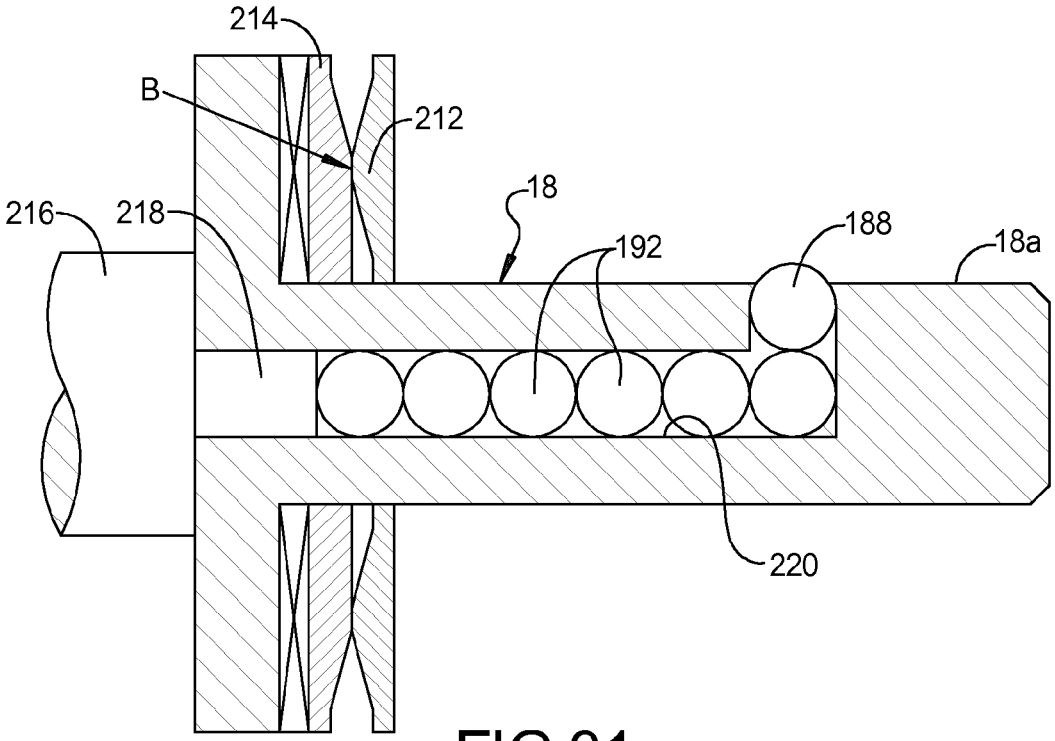
Figure 31B:
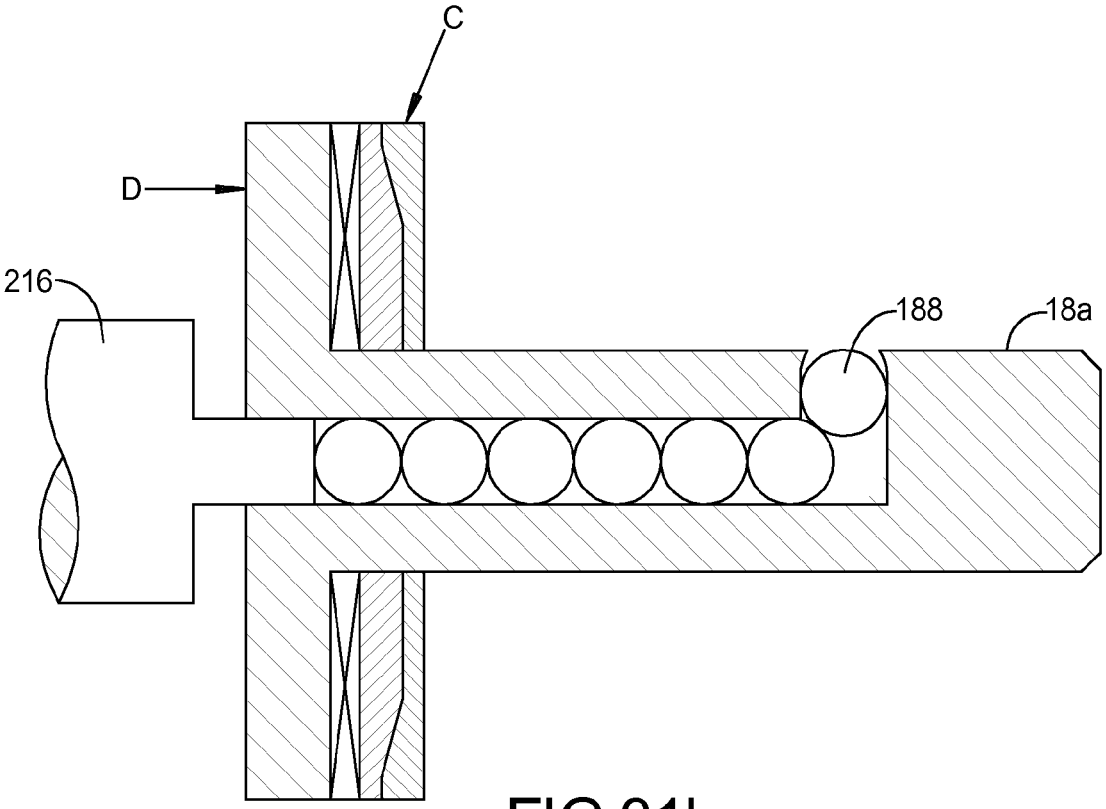
Figure 32A:
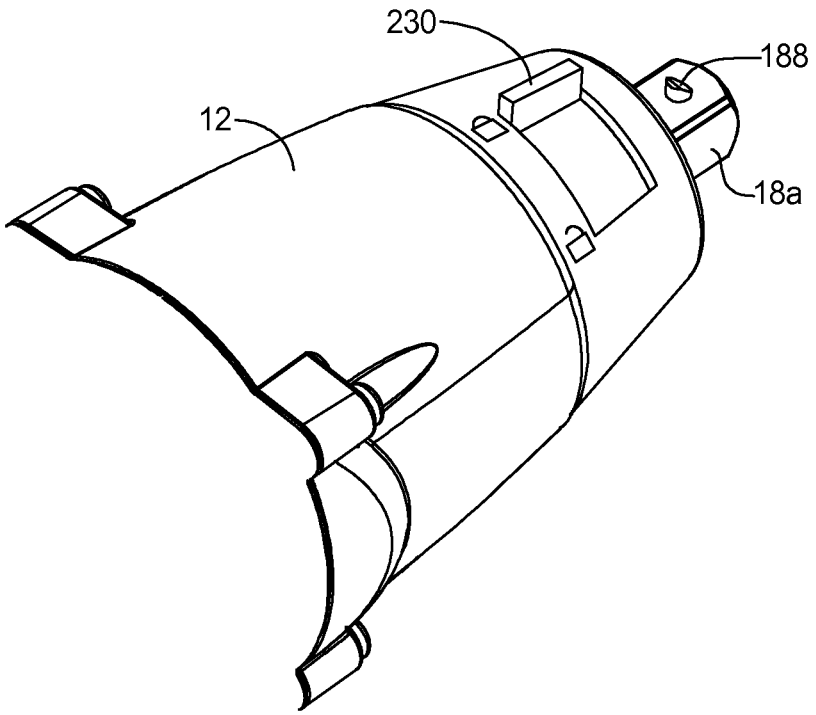
Figure 32B:
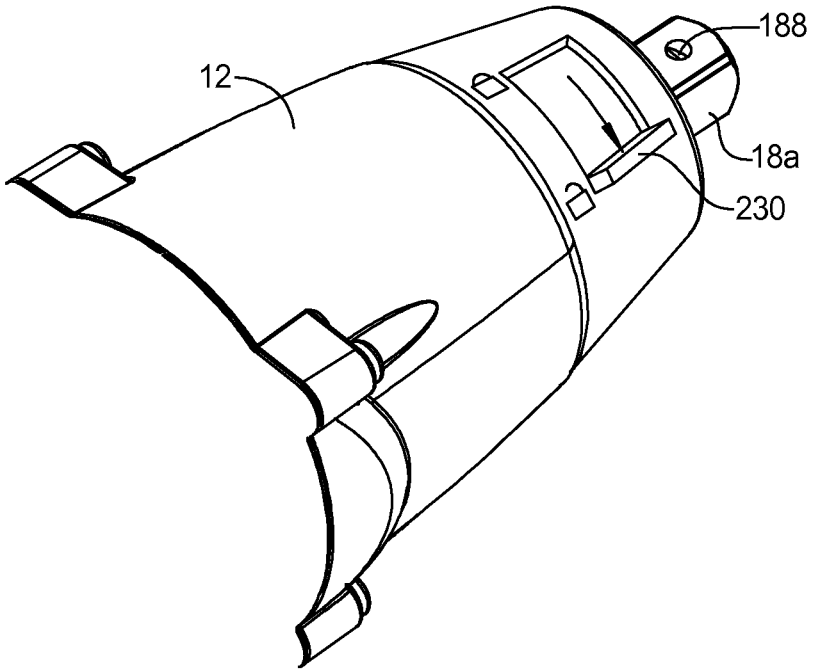
Figure 33:
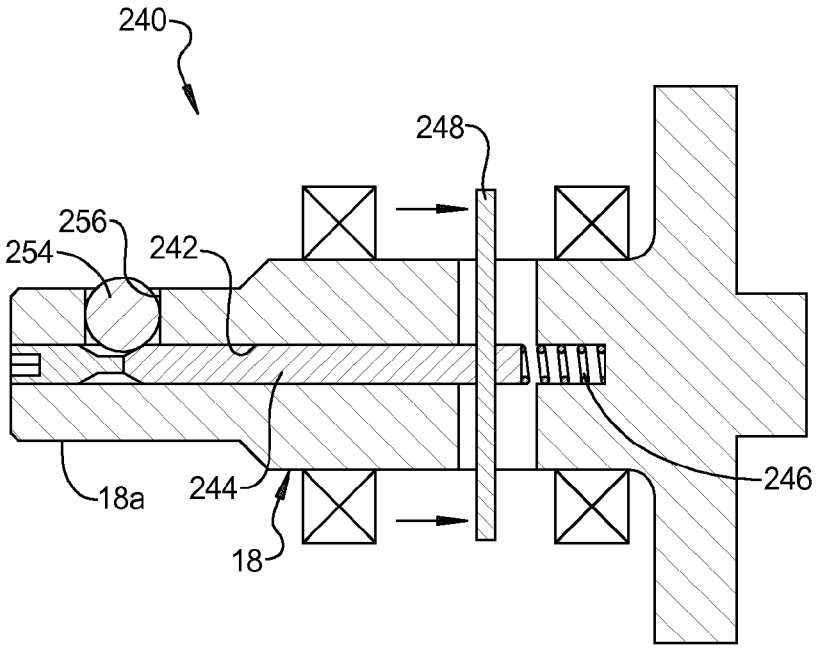
Figure 34:
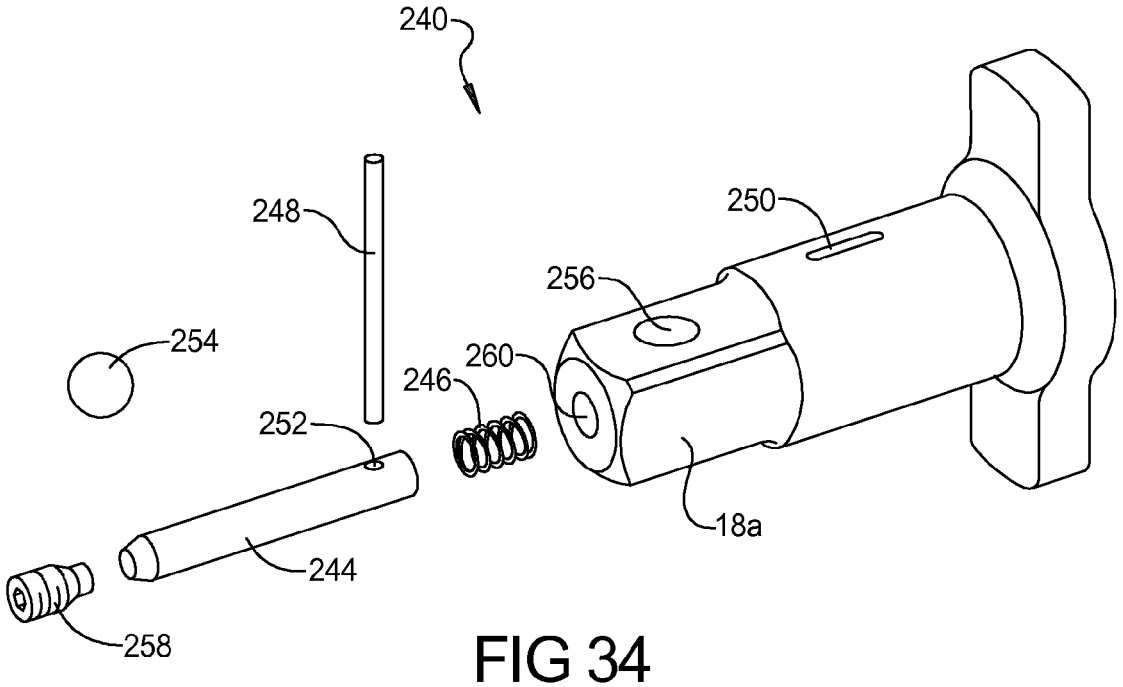
Figure 35:
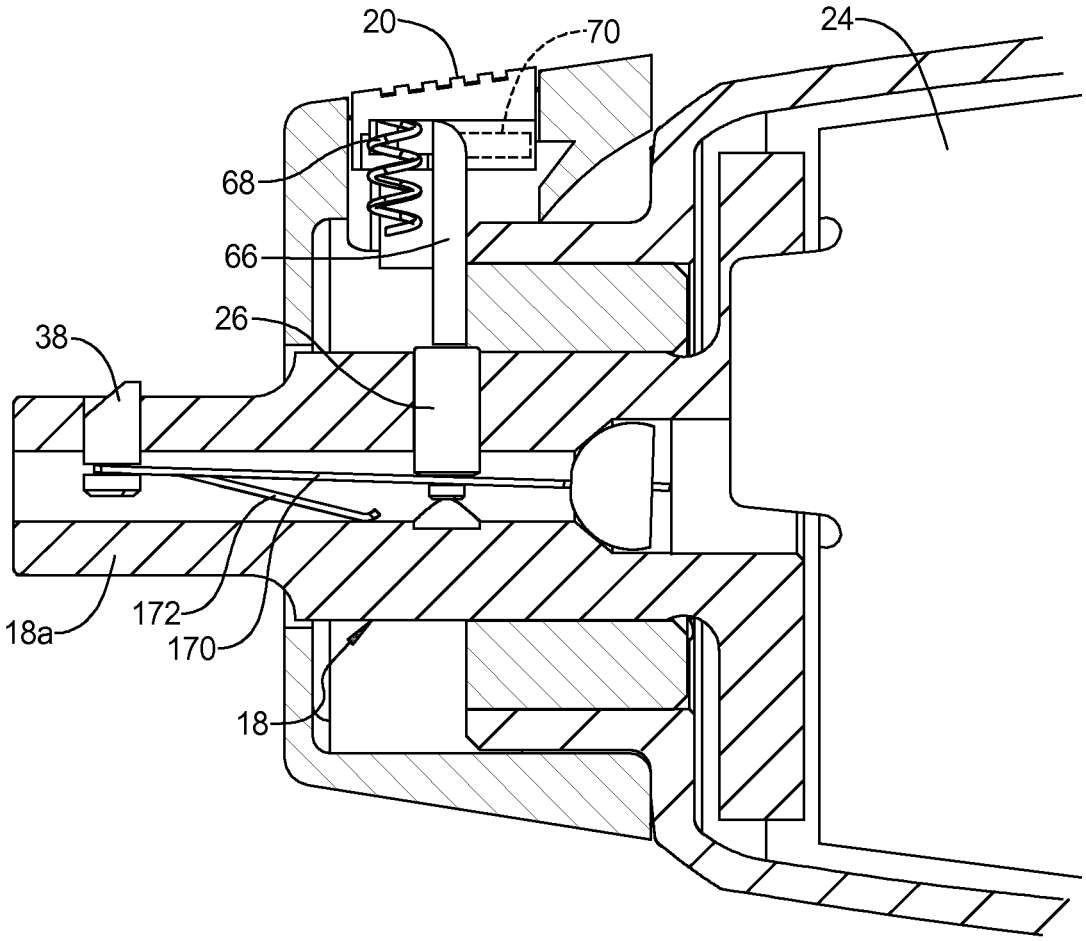
Figure 36:
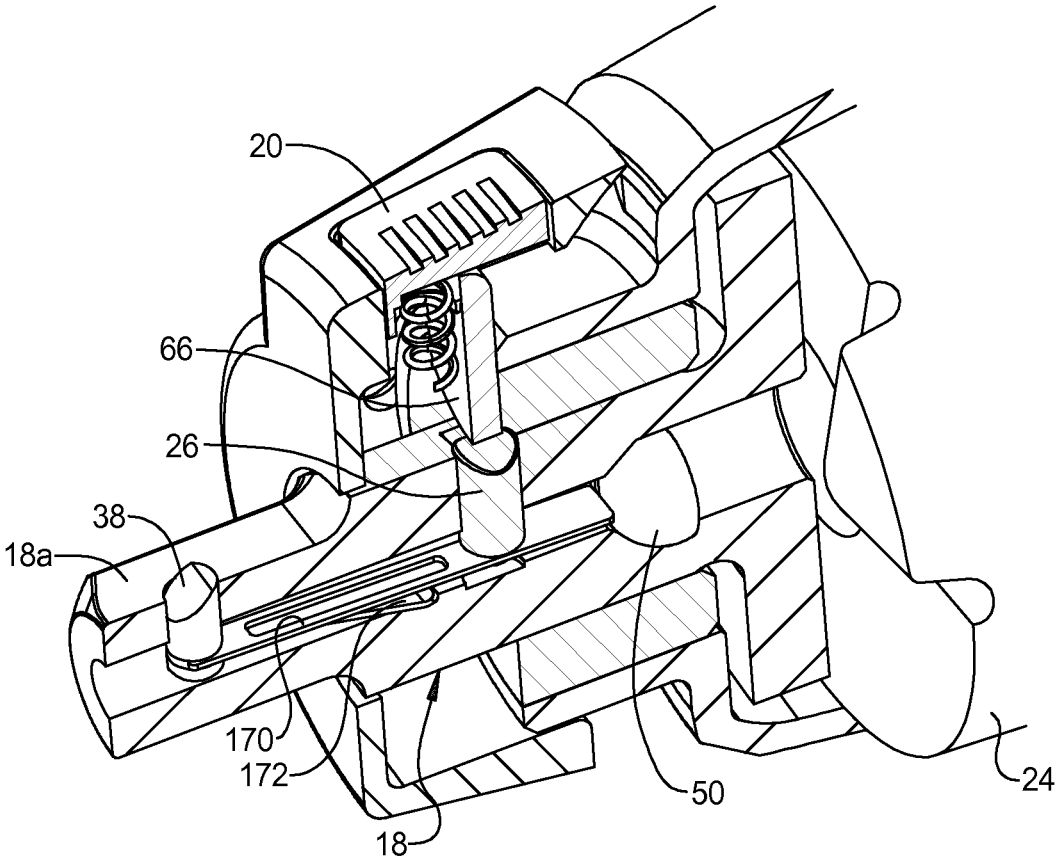
Figure 37A:
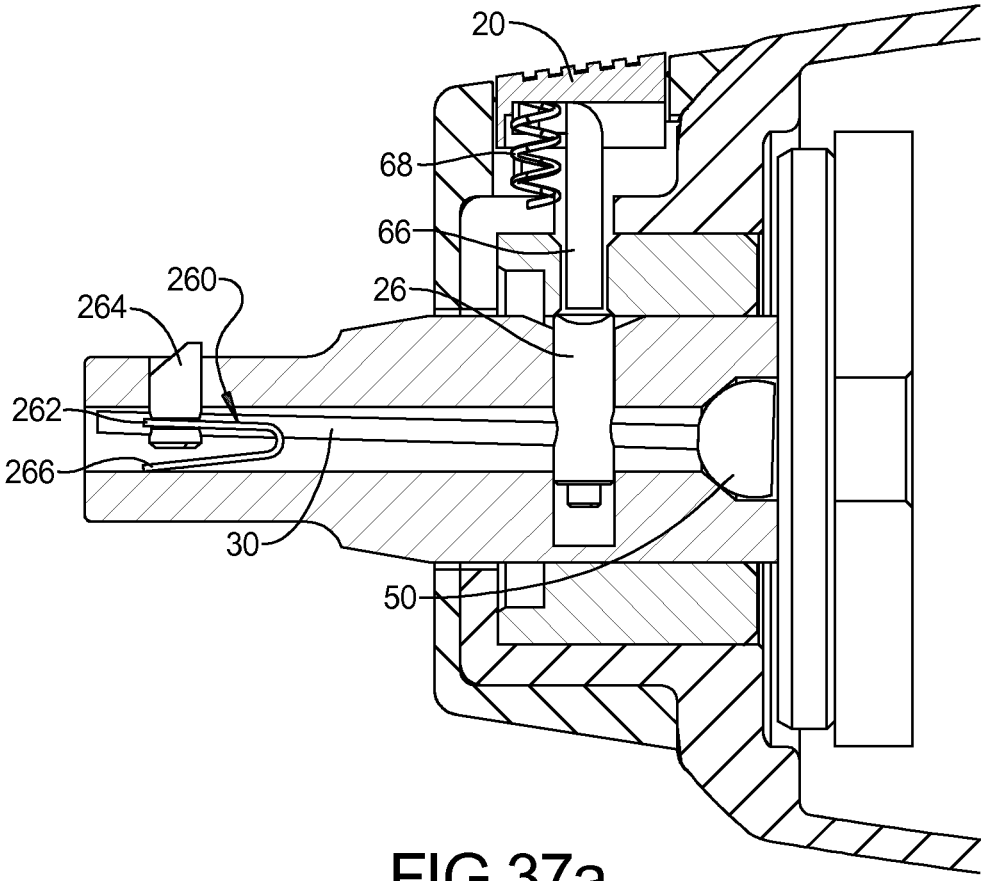
Figure 37B:
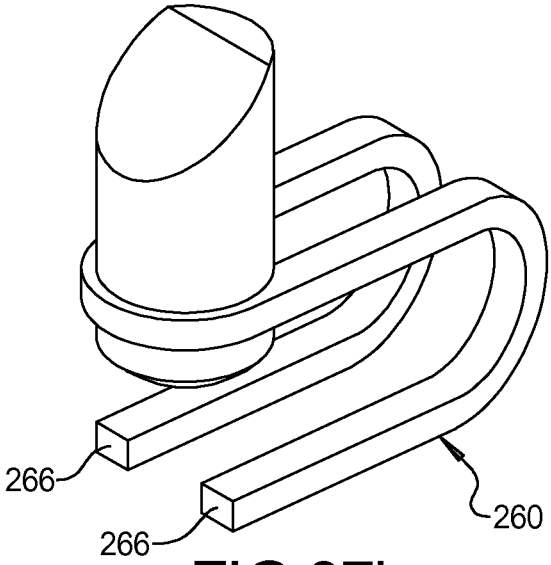

FIGS. 13*a* and 13*b* are perspective views of the anvil shaft showing alternative divot configurations;

FIG. 14 is a perspective view of an omni-directional socket release mechanism according to a third embodiment of the present disclosure;

FIG. 15 is a cross-sectional view of the omni-directional socket release mechanism of FIG. 14 in an engaged position;

FIG. 16 is a cross-sectional view of the omni-directional socket release mechanism of FIG. 14 in a release position;

FIG. 17 is a perspective view of the cover sub-assembly of the omni-directional socket release mechanism removed from the impact wrench;

FIG. 18 is an exploded perspective view of the omni-directional socket release mechanism shown in FIG. 14;

FIG. 19 is a rear exploded perspective view of components of the omni-directional socket release mechanism shown in FIG. 14;

FIG. 20 is a perspective view of an omni-directional socket release mechanism according to a fourth embodiment of the present disclosure;

FIG. 21*a* is a cross-sectional view of the omni-directional socket release mechanism of FIG. 20 in an engaged position;

FIG. 21*b* is a cross-sectional view of the omni-directional socket release mechanism of FIG. 20 in a release position;

FIG. 22 is an exploded perspective view of an electro-mechanically actuated socket release mechanism according to a fifth embodiment of the present disclosure;

FIG. 23 is a partially assembled perspective view of the electro-mechanically actuated socket release mechanism shown in FIG. 22;

FIG. 24 is a partially exploded perspective view of the electro-mechanically actuated socket release mechanism shown in FIG. 22;

FIG. 25*a* is a cross-sectional view of the electro-mechanically actuated socket release mechanism of FIG. 22, shown in an engaged position;

FIG. 25*b* is a cross-sectional view of the electro-mechanically actuated socket release mechanism of FIG. 22, shown in a release position;

FIG. 26 is a perspective view of an impact wrench illustrating the potential locations of a switch for actuating the electro-mechanically actuated socket release mechanism of FIG. 22;

FIG. 27 is a cross-sectional view of an omni-directional socket release mechanism according to a sixth embodiment of the present disclosure, shown in an engaged position;

FIG. 28 is a perspective view of the omni-directional socket release mechanism of FIG. 27;

FIG. 29 is a cross-sectional view of an omni-directional socket release mechanism according to a seventh embodiment of the present disclosure, shown in a released position;

FIG. 30 is a side view of an impact wrench having a rotary lock and release collar for engaging and disengaging an omni-directional socket release mechanism according to an eighth embodiment of the present disclosure;

FIG. 31*a* is a cross-sectional view of the omni-directional socket release mechanism of FIG. 30, shown in an engaged position;

FIG. 31*b* is a cross-sectional view of the omni-directional socket release mechanism of FIG. 30, shown in a release position;

FIG. 32*a* is a side perspective view of an impact wrench having a rotary lock and release slider tab for engaging and disengaging an omni-directional socket release mechanism according to a ninth embodiment of the present disclosure;

FIG. 32*b* is a side perspective view of the impact wrench of FIG. 32*a* with the release slider tab in a release position;

FIG. 33 is a cross-sectional view of a socket release mechanism according to a tenth embodiment;

FIG. 34 is an exploded perspective view of the socket release mechanism of FIG. 33;

FIG. 35 is a cross-sectional view of a socket release mechanism according to an eleventh embodiment;

FIG. 36 is a cross-sectional perspective view of the socket release mechanism of FIG. 35;

FIG. 37*a* is a cross-sectional view of a socket release mechanism according to a twelfth embodiment;

FIG. 37*b* is a perspective view of a retainer pin and spring mechanism for use with the socket release mechanism of FIG. 37*a;*

Figure 38:
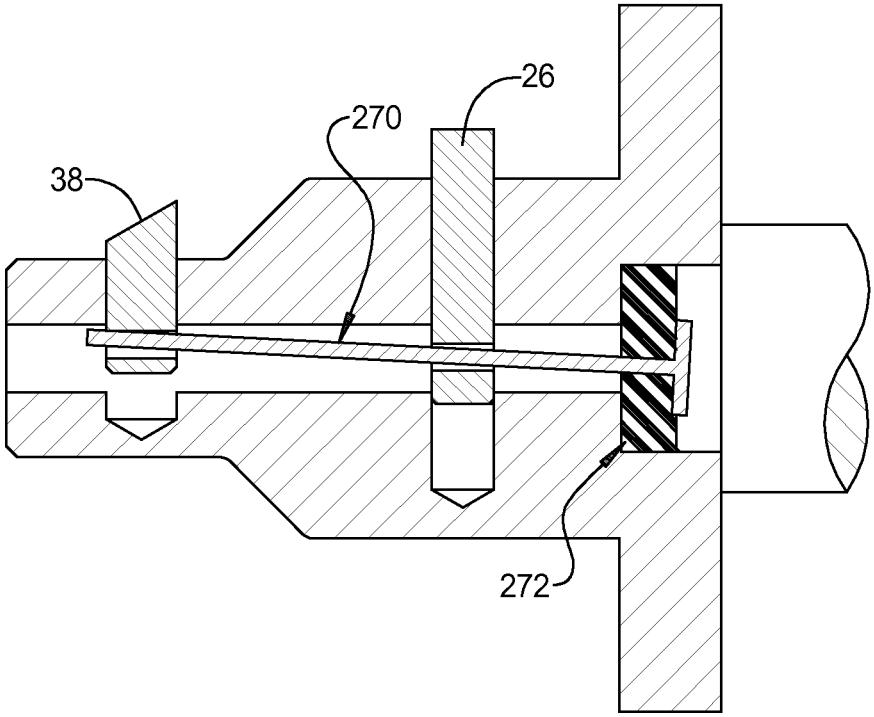
Figure 39:
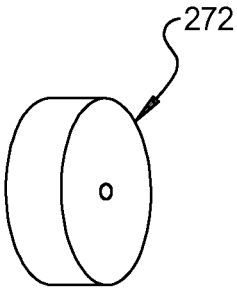
Figure 40:
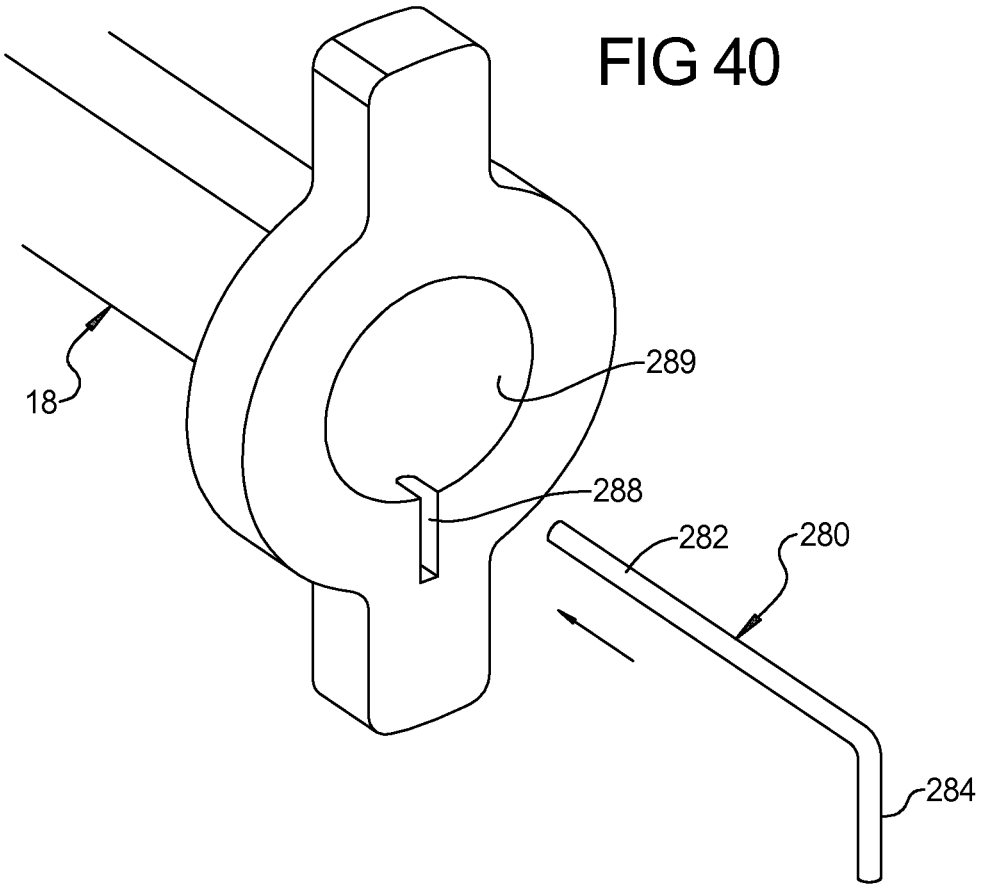
Figure 41:
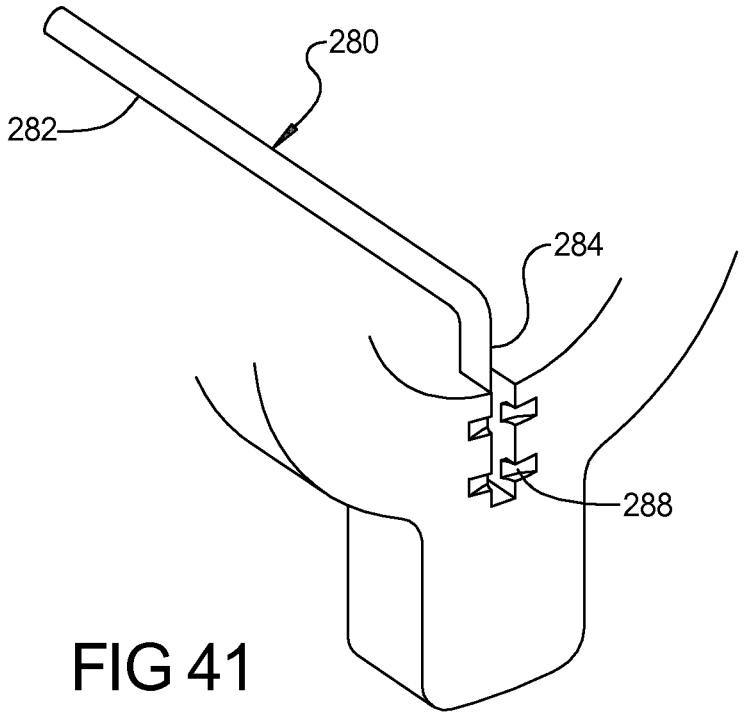
Figure 42:
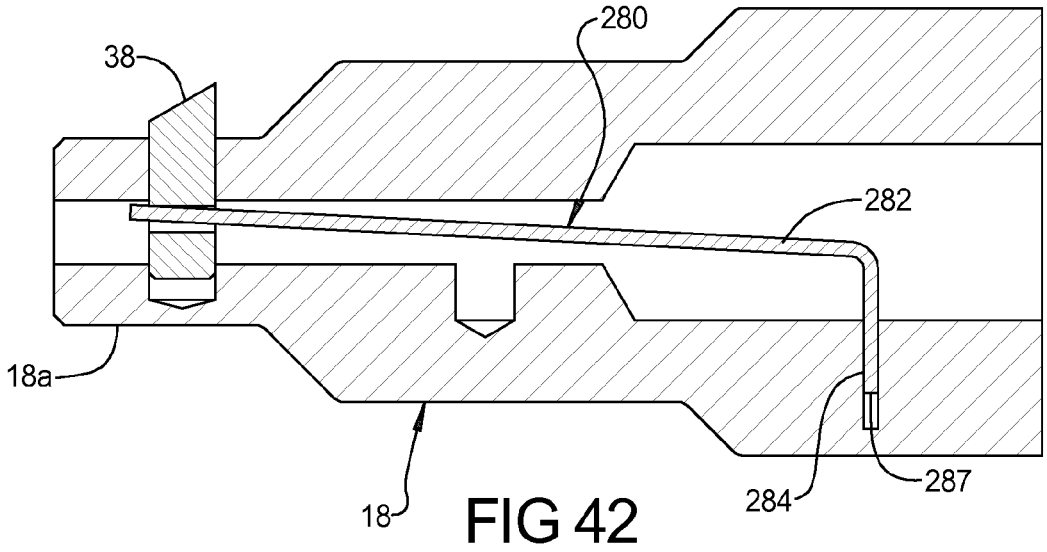
Figure 43:
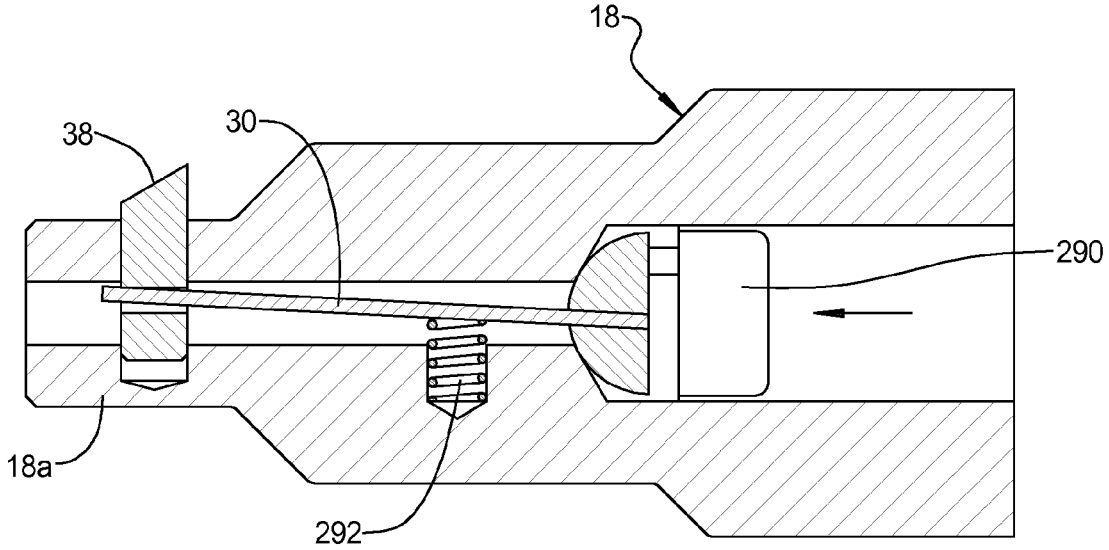
Figure 45:
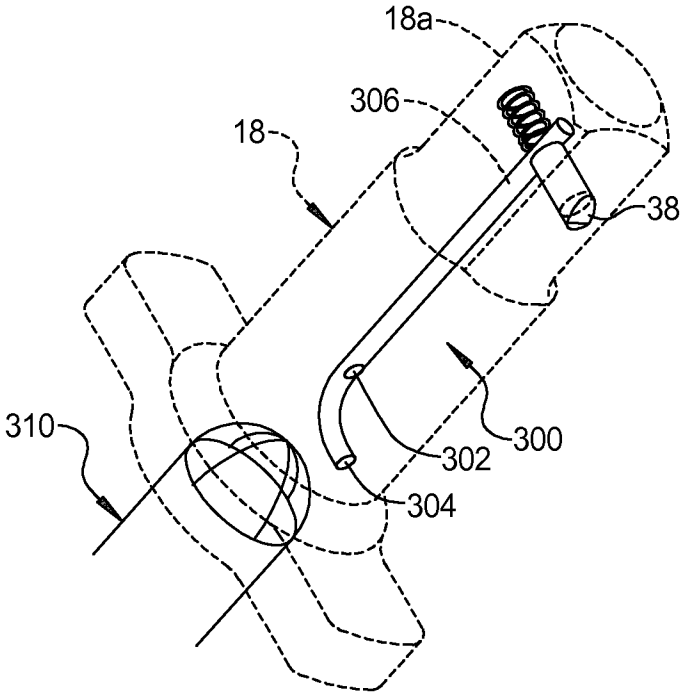
Figure 44:
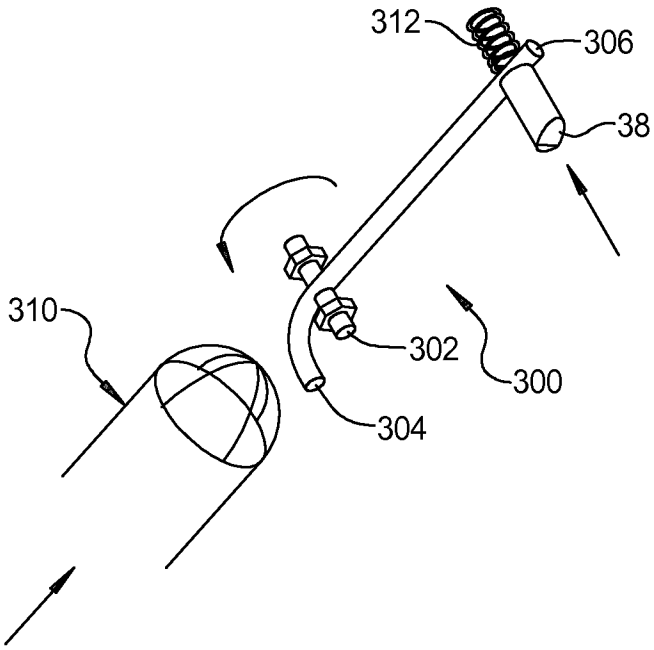
Figure 46:
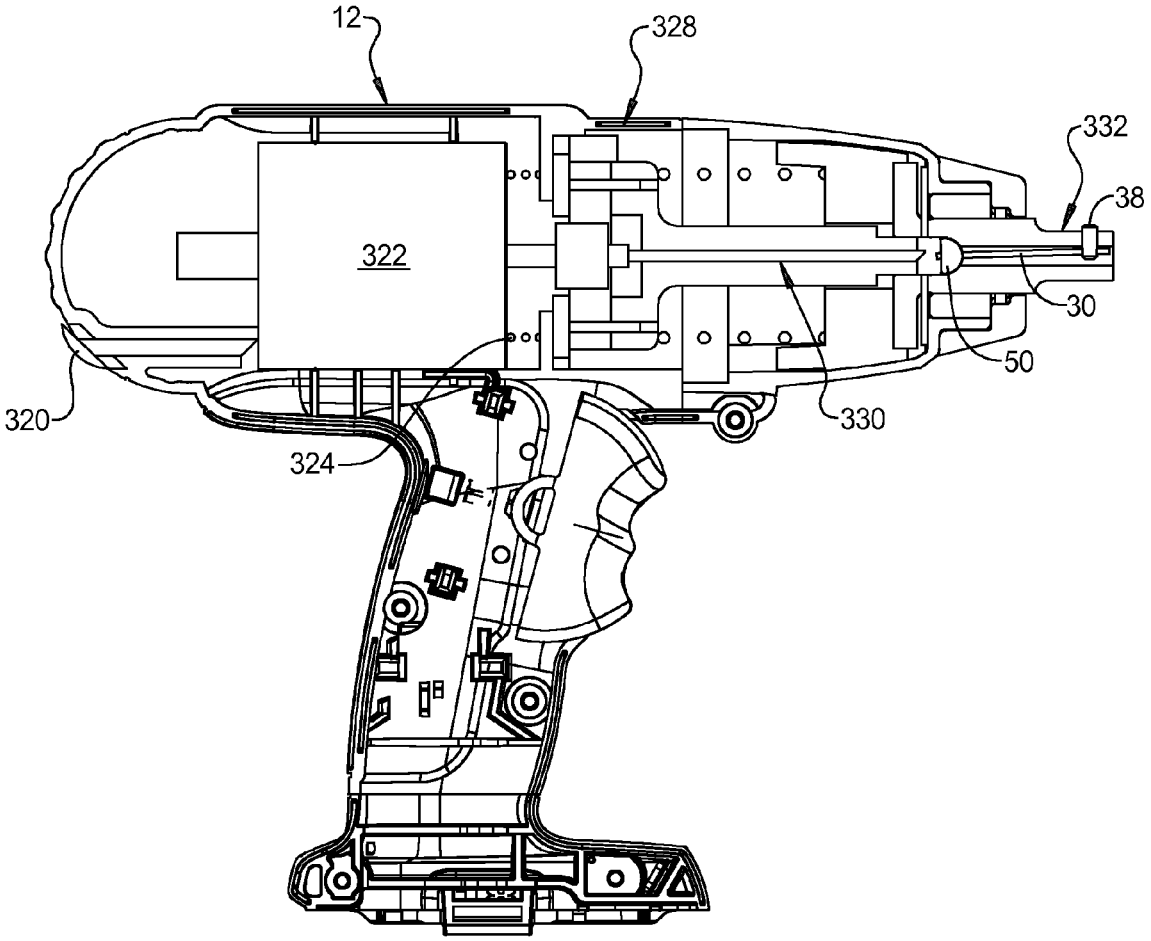
Figure 47:
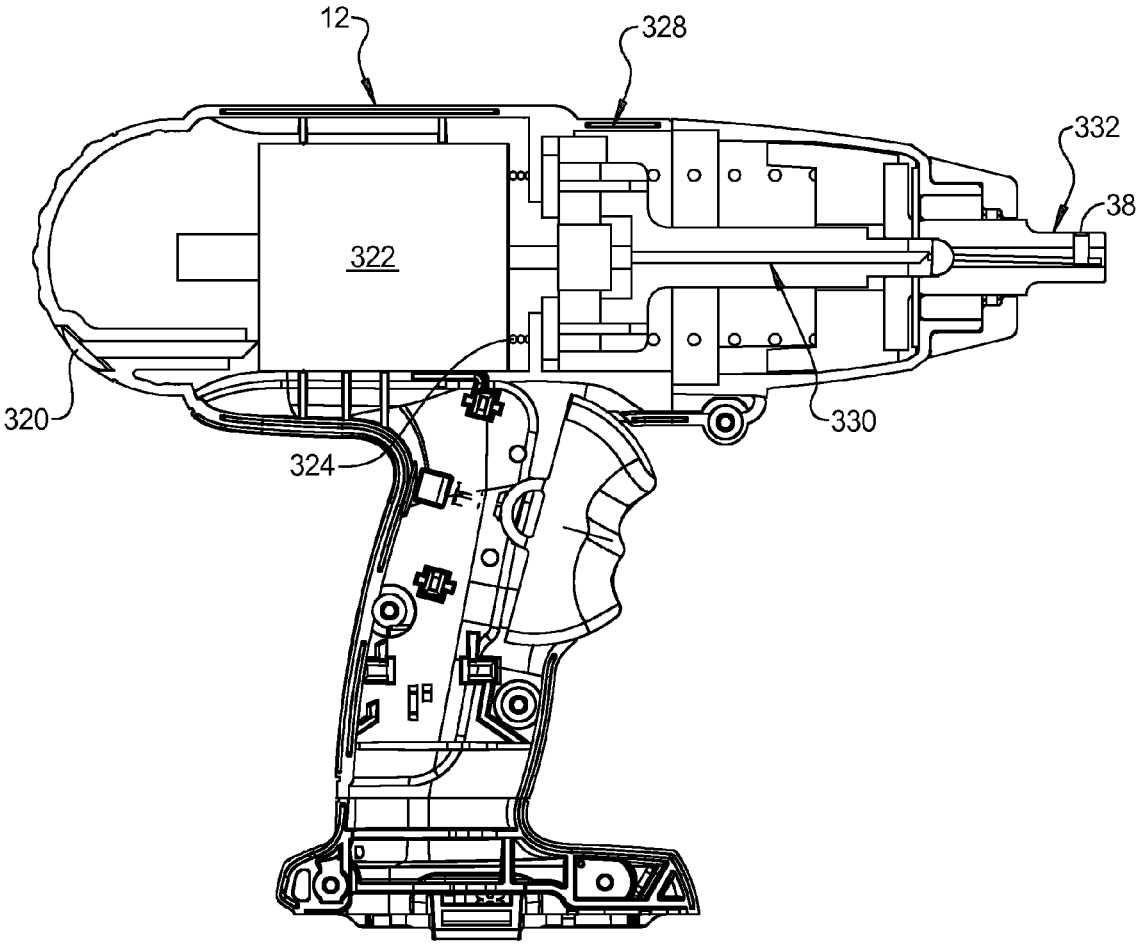
Figure 48:
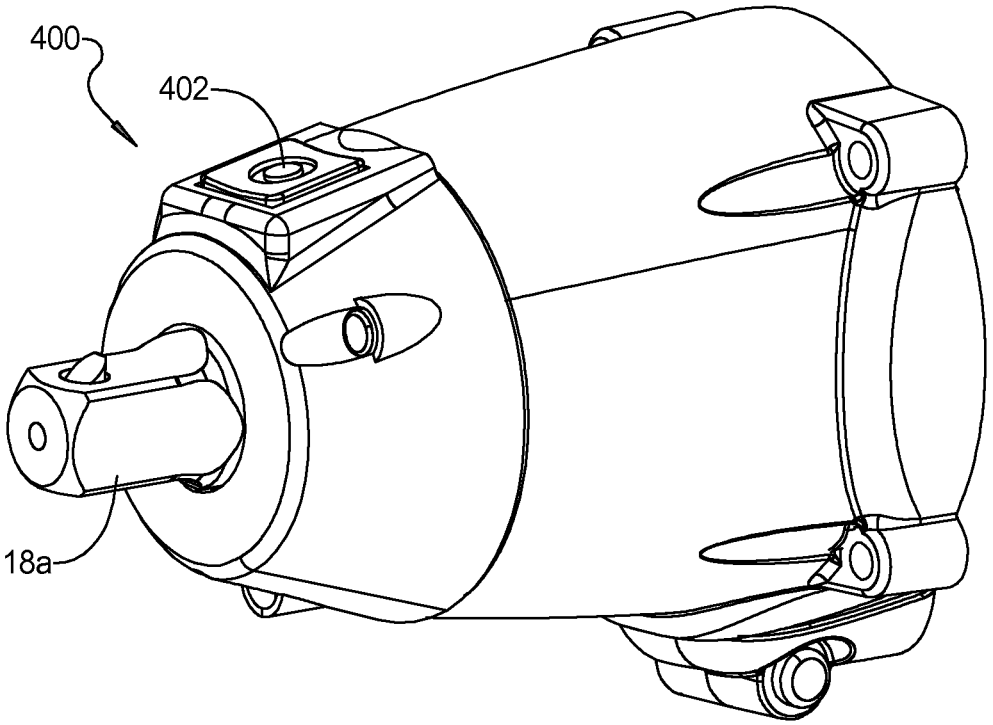
Figure 49:
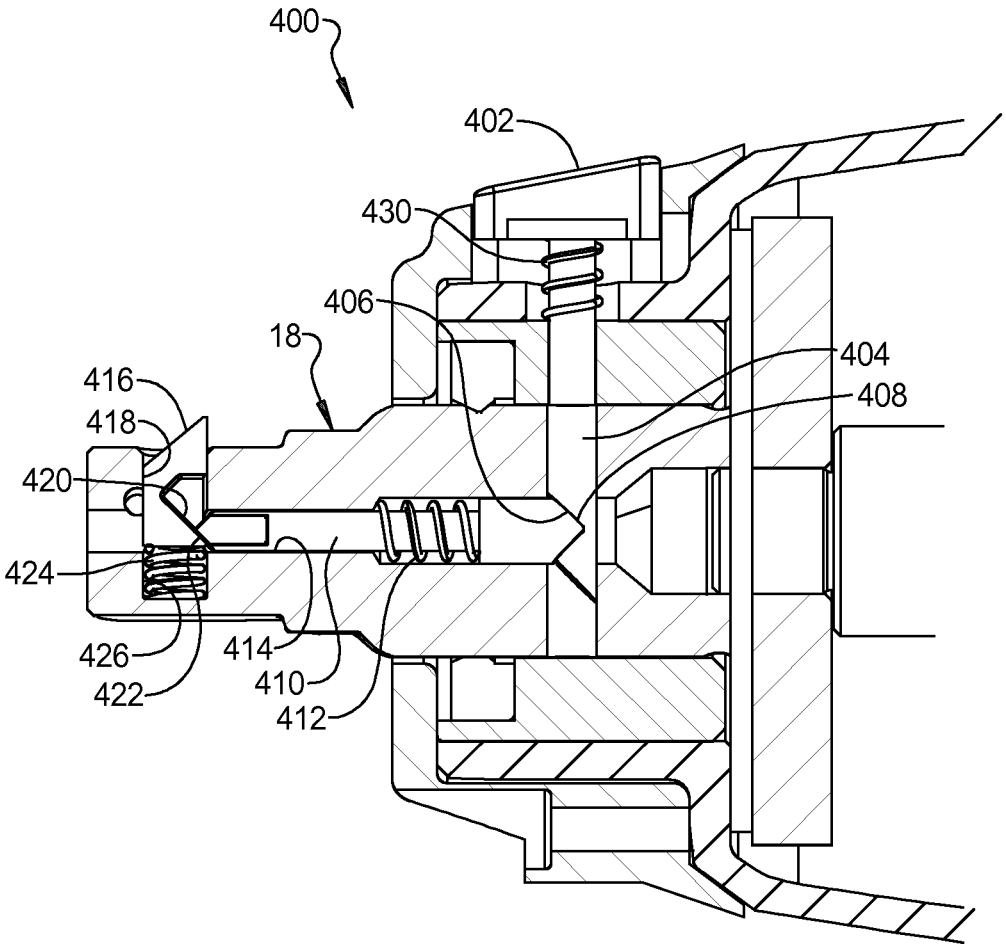
Figure 50:
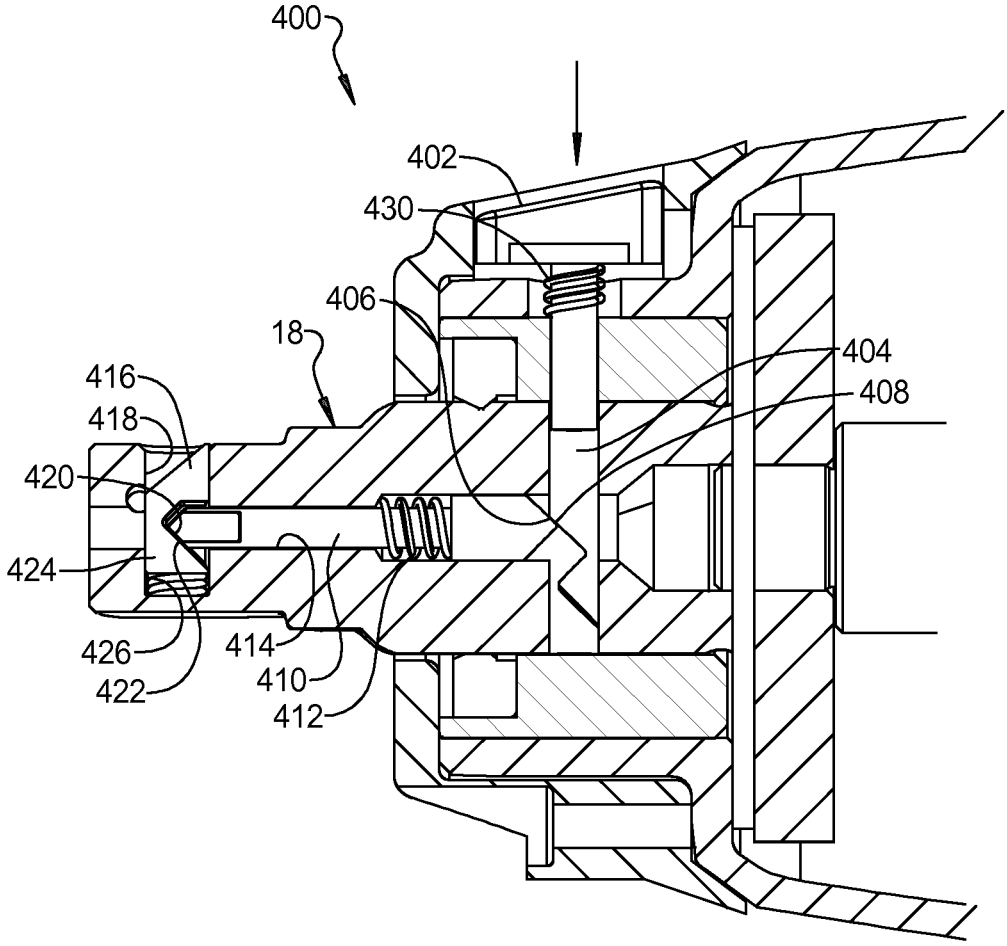
Figure 51A:
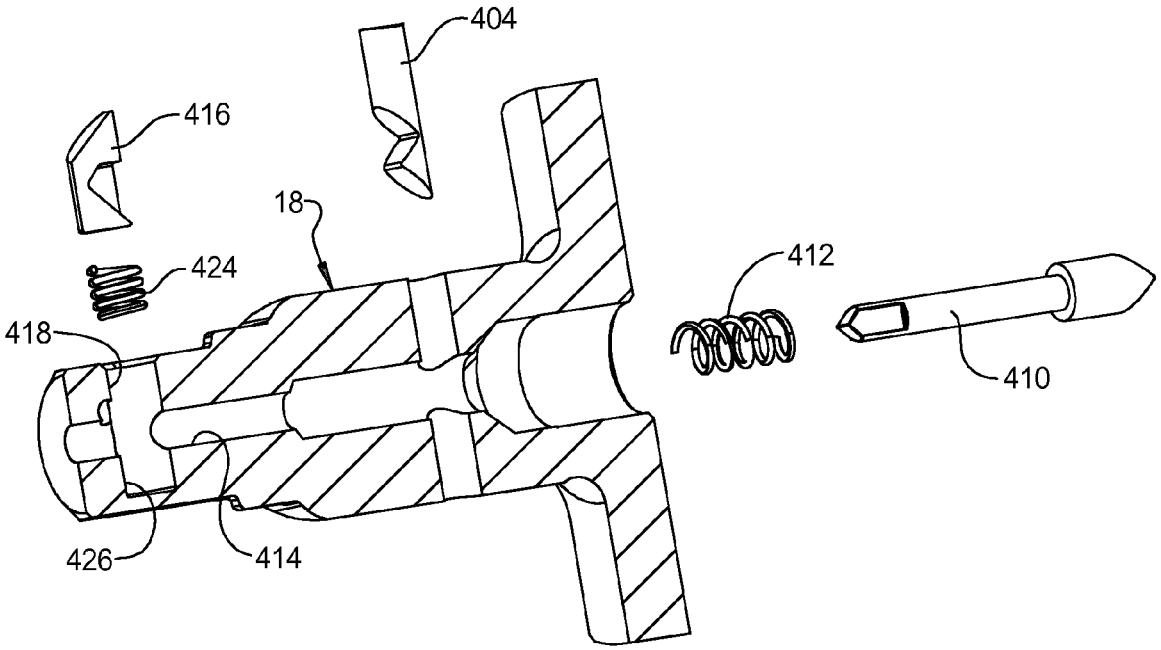
Figure 51B:
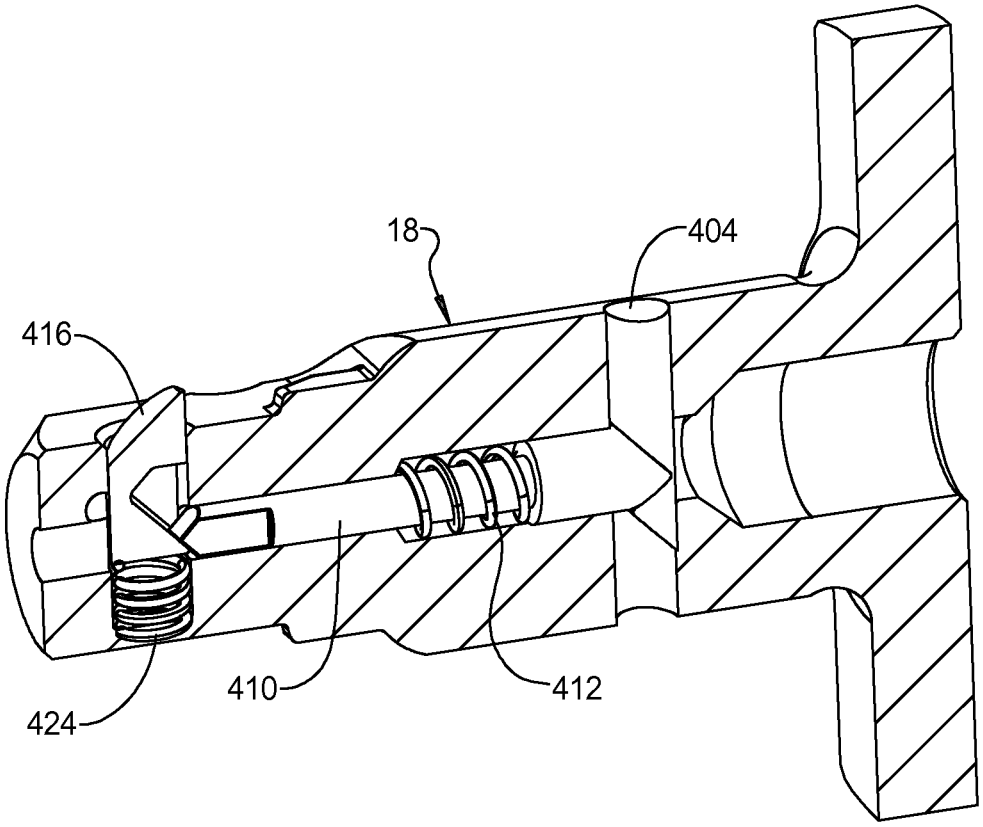

FIG. 38 is a cross-sectional view of a socket release mechanism according to a thirteenth embodiment;

FIG. 39 is a perspective view of a flexible elastomeric plug for use with the socket release mechanism of FIG. 38;

FIG. 40 is an exploded perspective view of a slot and lever pin for use in a rear of the anvil of a socket release mechanism according to a fourteenth embodiment;

FIG. 41 is a perspective view of the lever pin inserted into the slot in the anvil shown in FIG. 40;

FIG. 42 is a cross-sectional view of a socket release mechanism according to a fifteenth embodiment;

FIG. 43 is a cross-sectional view of a socket release mechanism according to a sixteenth embodiment;

FIG. 44 is a schematic illustration of a socket release mechanism according to a seventeenth embodiment;

FIG. 45 is a schematic illustration of the socket release mechanism shown in FIG. 44;

FIG. 46 is a schematic cross-sectional view of a socket release mechanism according to an eighteenth embodiment, shown in an engaged position;

FIG. 47 is a schematic cross-sectional view of the socket release mechanism of FIG. 46 shown in a release position;

FIG. 48 is a perspective view of a push button socket release mechanism with a cam pin according to a nineteenth embodiment of the present disclosure;

FIG. 49 is a cross-sectional view of the push button socket release mechanism of FIG. 48, shown in an engaged position;

FIG. 50 is a cross-sectional view of the push button socket release mechanism of FIG. 48, shown in a release position;

FIG. 51*a* is an exploded partially cut-away perspective view of the anvil sub-assembly of the push button socket release mechanism of FIG. 48;

FIG. 51*b* is an assembled partially cut-away perspective view of the anvil sub-assembly shown in FIG. 51*a;*

Figure 52A:
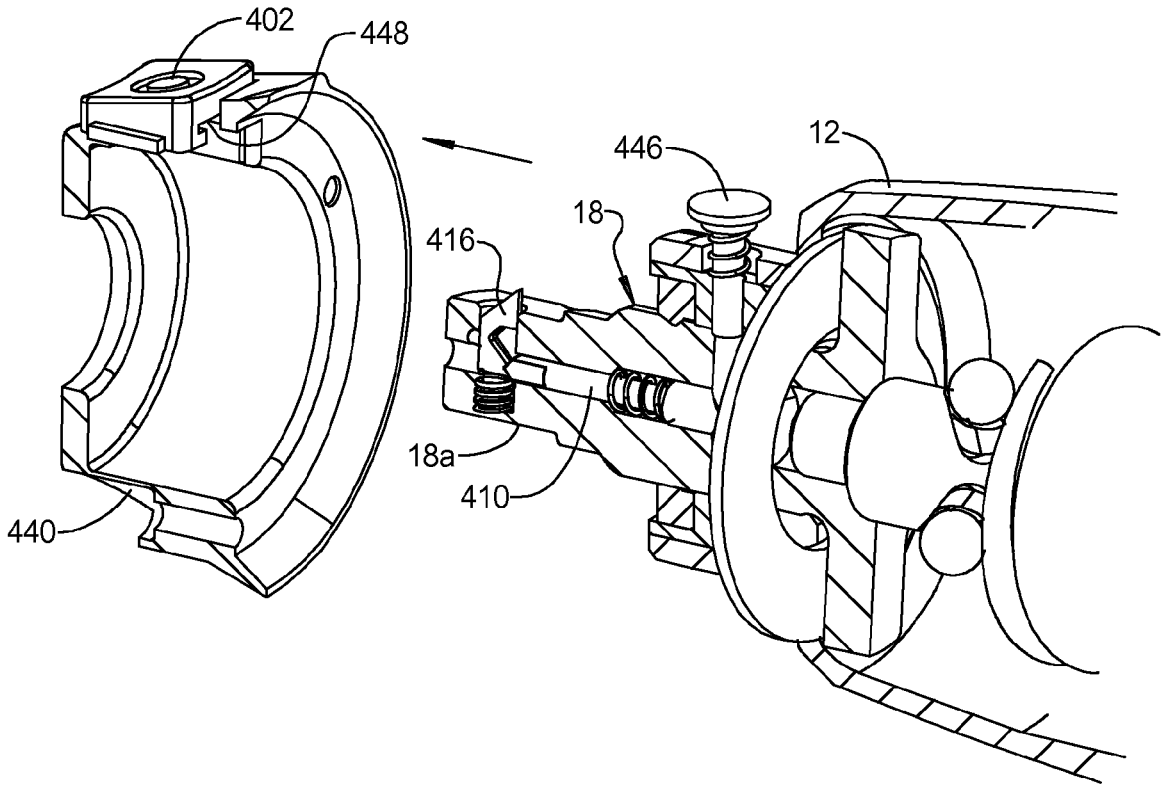
Figure 52B:
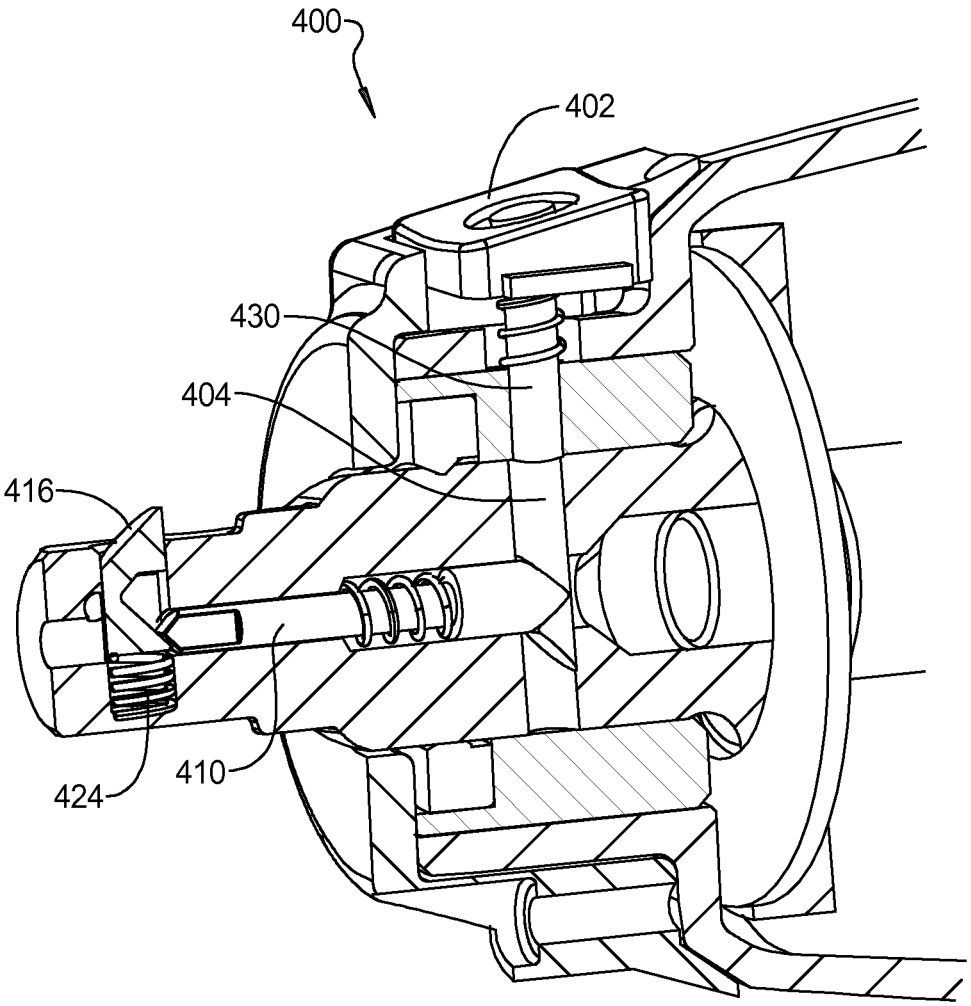
Figure 53:
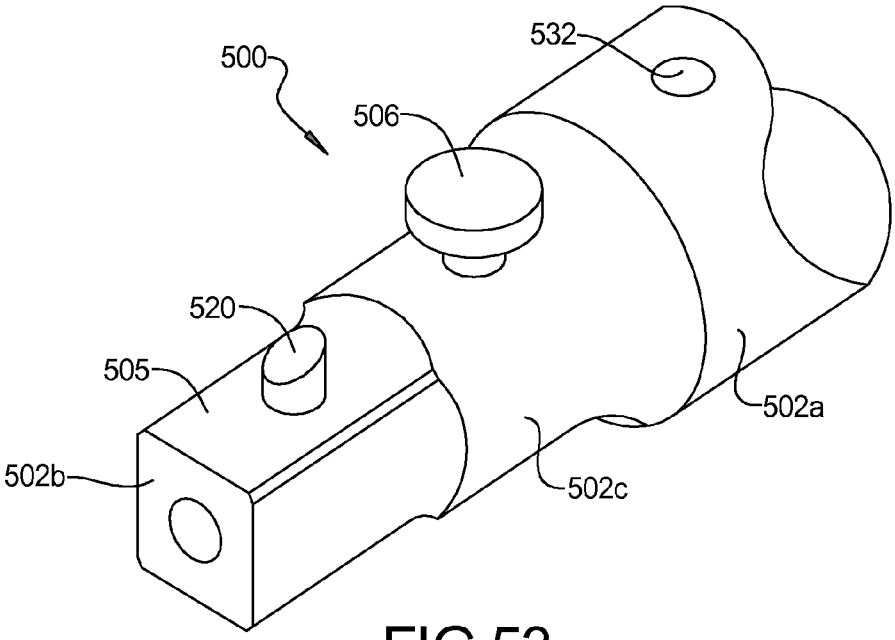
Figure 54:
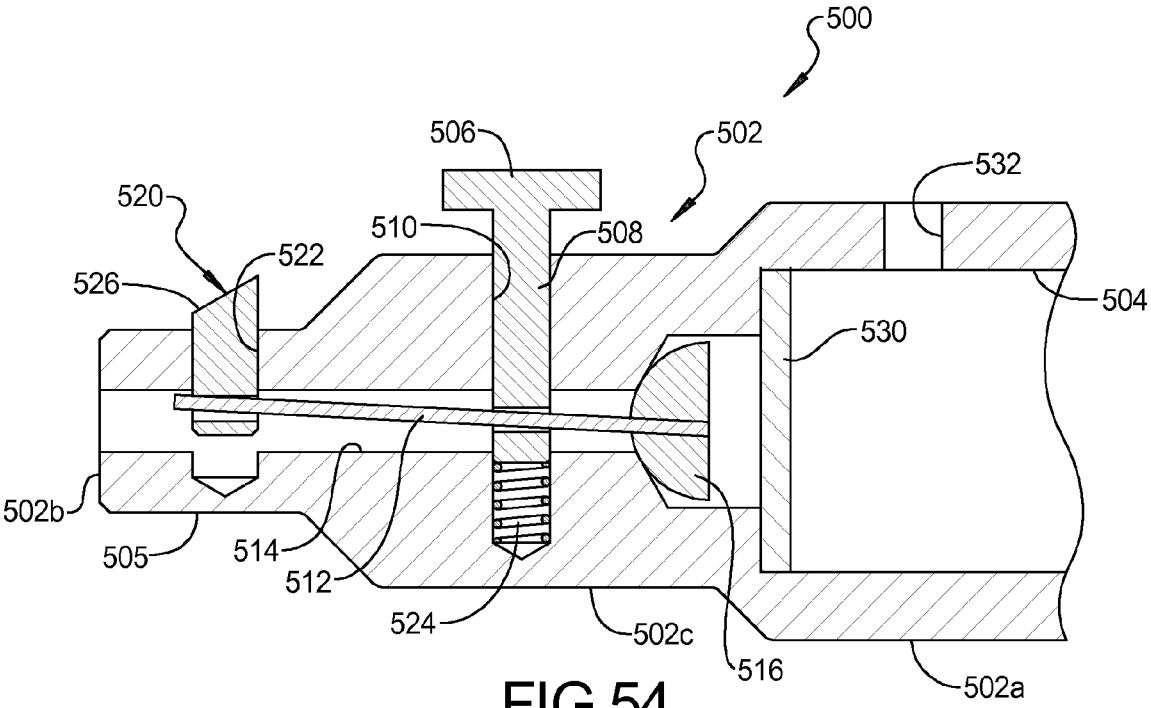

FIG. 52*a* is a near completely assembled partially cut-away perspective view of the push button socket release mechanism of FIG. 48;

FIG. 52*b* is an assembled partially cut-away perspective view of the push button socket release mechanism of FIG. 48;

FIG. 53 is a perspective view of a push-button quick release accessory for attachment to an existing drive tool; and FIG. 54 is a cross-sectional view of the push-button quick release accessory shown in FIG. 53.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
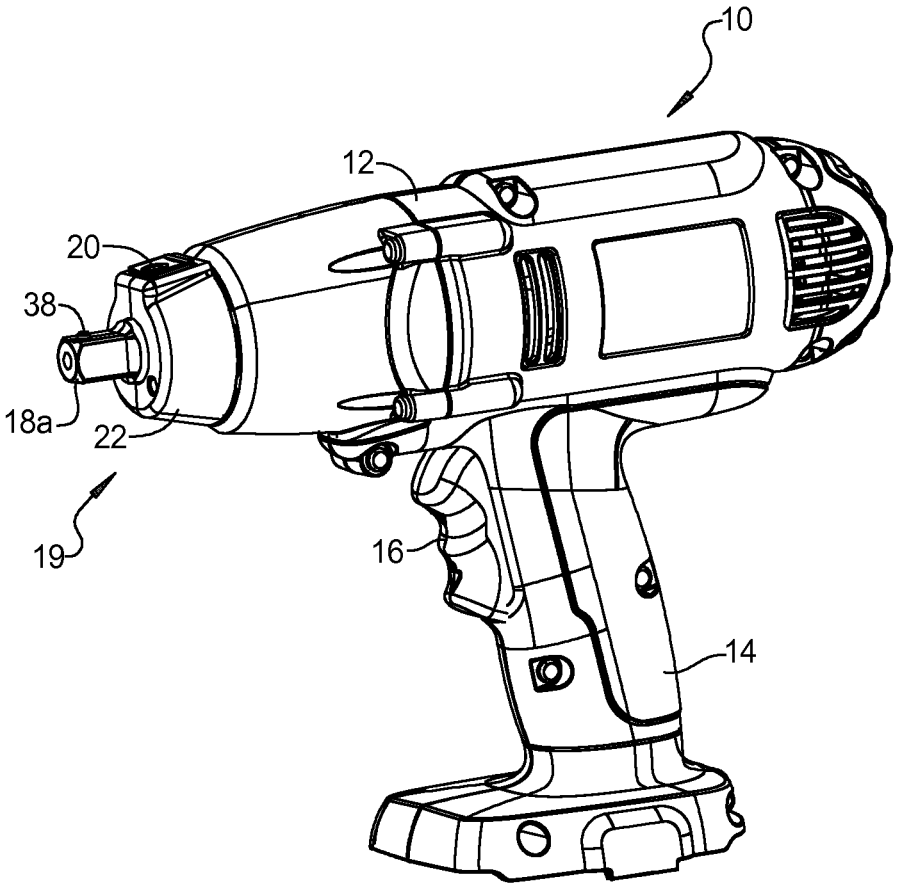
FIG. 1 is a perspective view of an impact wrench incorporating a push button socket release mechanism according to the principles of the present disclosure.
Figure 2:
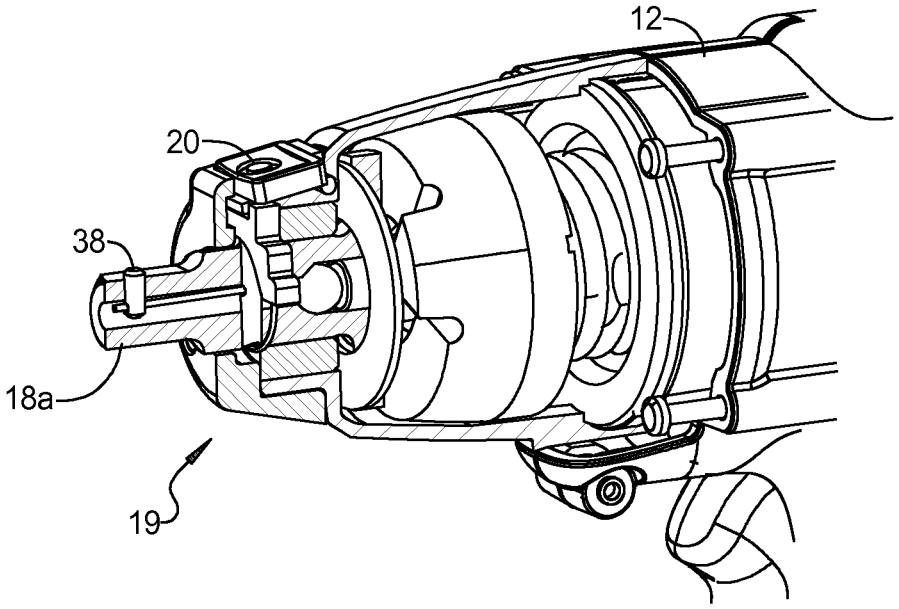
FIG. 2 is a partial cut-away perspective view of the push button socket release mechanism of FIG. 1*b* with the cover cut away.

With reference to FIG. 1, an impact wrench 10 is shown including a housing 12 having a handle 14 and a trigger mechanism 16 for activating the impact wrench 10. The housing 12 is adapted to receive a battery pack (not shown) for use as a cordless impact wrench. It should be understood that the present disclosure can also be applied to pneumatic, hydraulic and corded electrical impact wrench devices. The impact wrench includes a motor disposed within the housing 12 that drives an impact mechanism 24 that engages an anvil 18 which extends from the front end of the housing 12. In a typical impact wrench, the anvil 18 includes a square socket drive 18*a* which is designed to drive a socket wrench (not shown).

Figure 3:
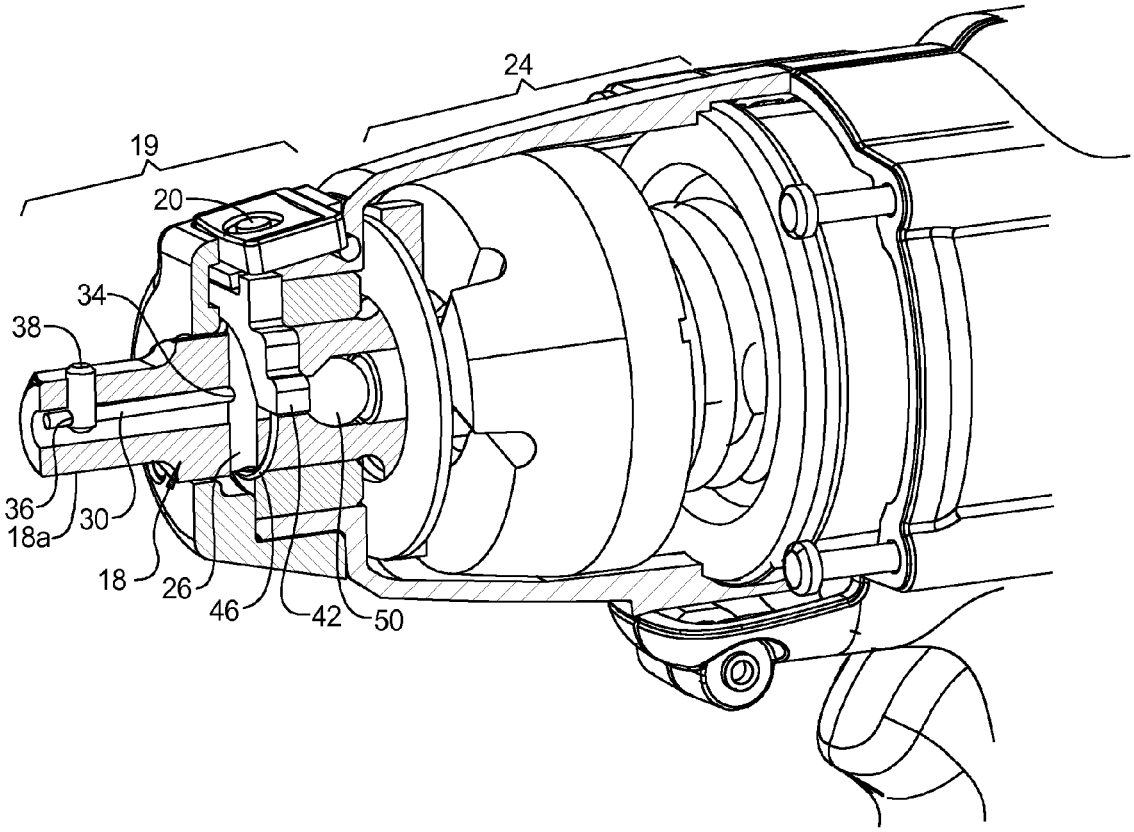
FIG. 3 is a cut-away perspective view of the push button socket release mechanism of FIG. 1.

With reference to the embodiment shown in FIGS. 1-9, a push-button socket release mechanism 19 is provided for retaining the socket wrench on the square socket drive 18*a* and for allowing a quick release thereof via the push-button 20 mounted to the cover 22 extending from the housing 12. Initially, it is noted that an impact mechanism 24 as generally known in the art, is shown in FIG. 3 for providing rotary impacts to the anvil 18 in a manner that is known in the art.

Figure 4:
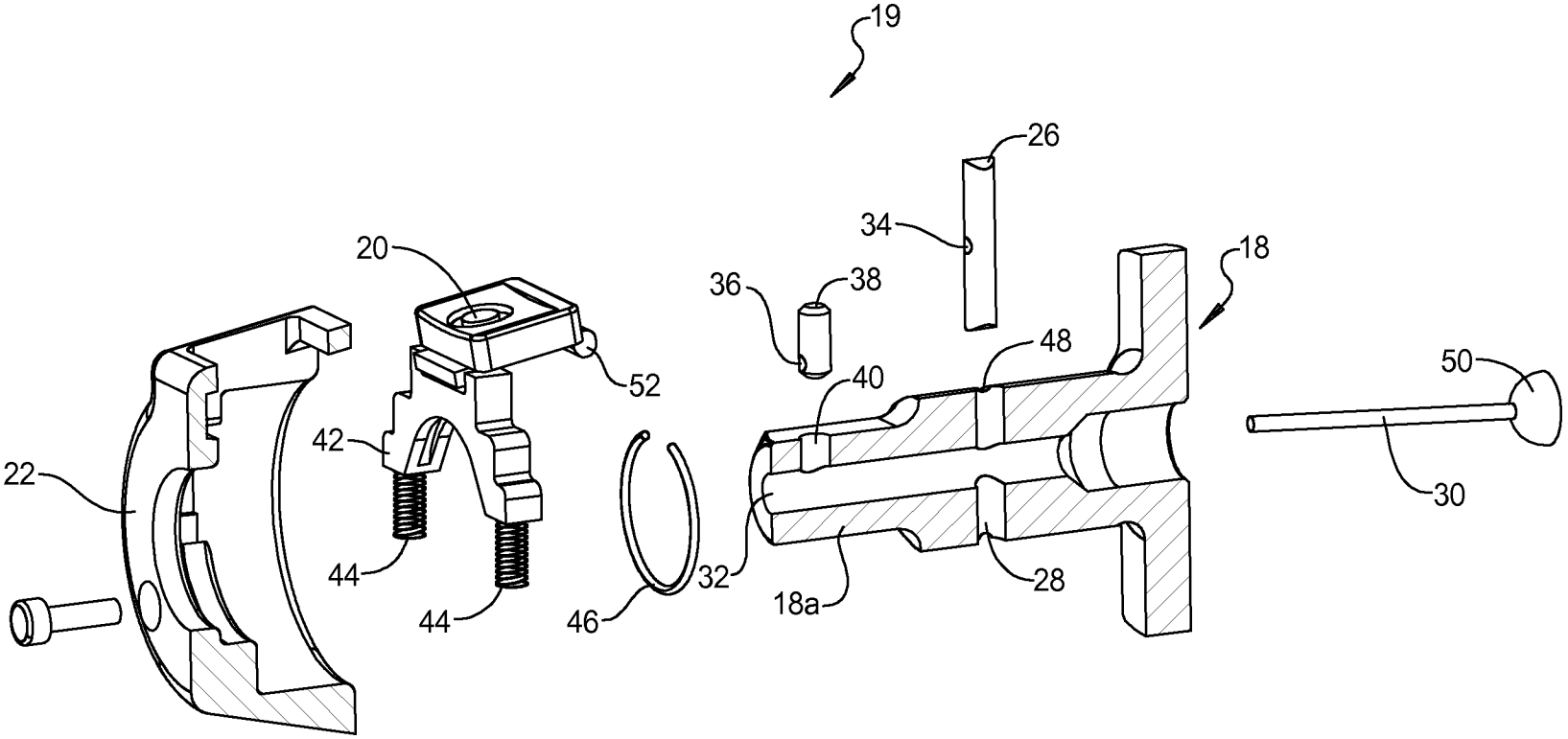
FIG. 4 is an exploded perspective view of the push button socket release mechanism of FIG. 1.

With reference to the exploded perspective view of FIG. 4, the components of the push-button socket release mechanism 19 will now be described. The push-button socket release mechanism 19 includes an actuator pin 26 that is received in a transverse bore 28 that extends through the anvil 18. A lever pin 30 is inserted through an axially extending bore 32 provided in the anvil 18. The lever pin 30 engages a transverse aperture 34 provided in the actuator pin 26. The lever pin also engages a transverse bore 36 provided in a retainer pin 38. The retainer pin 38 is received in a transverse bore 40 provided in the square socket drive 18*a* of anvil 18.

A cam actuator 42 is connected to the push-button 20 and partially encircles the anvil 18 at the location of the actuator pin 26. A pair of springs 44 are provided to bias the cam actuator 42 away from the anvil 18. Pressing the push-button 20 counters the force of the springs 44 to cause the cam actuator 42 to move towards the anvil 18. A hog ring 46 is provided for receipt in an annular groove 48 in the anvil 18 and for securing the cam actuator 42 in its axial position along the anvil 18.

Figure 5:
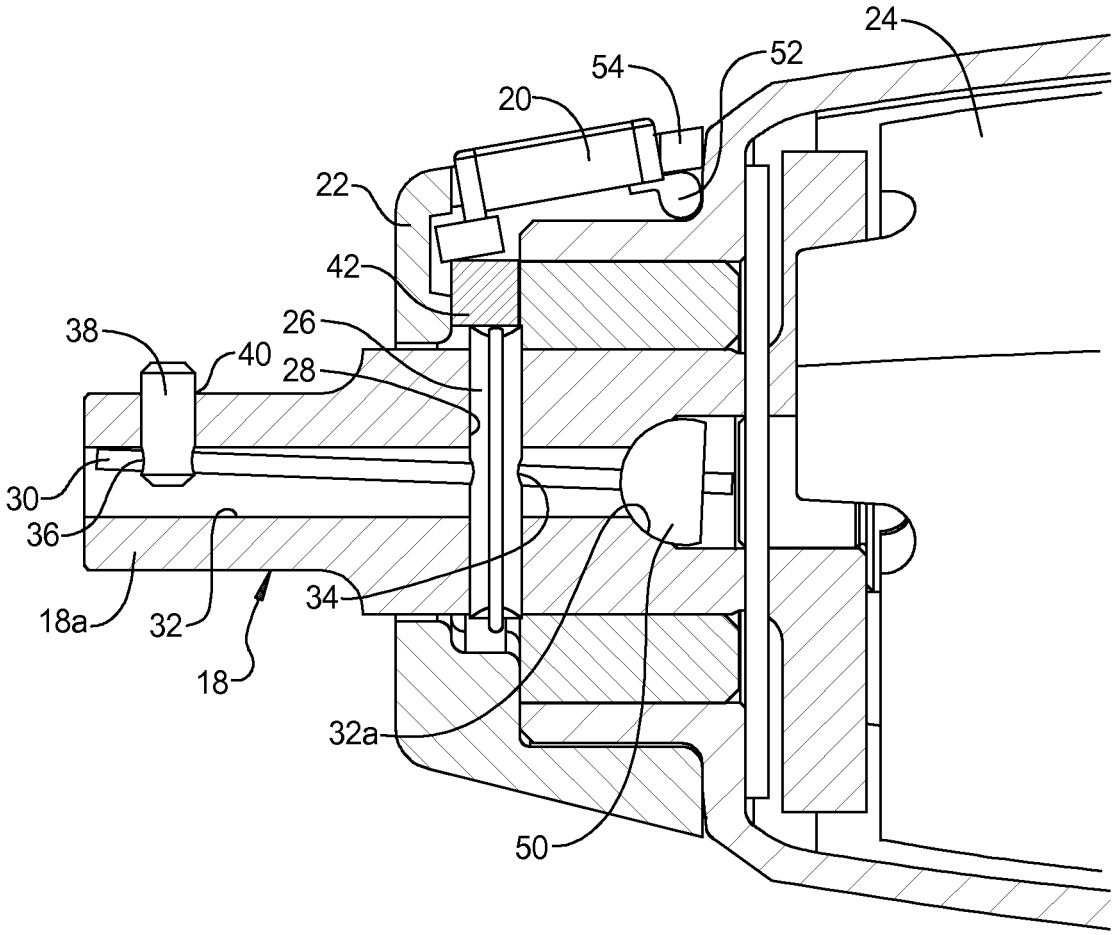
FIG. 5 is a cross-sectional view of the push button socket release mechanism of FIG. 1, shown in the engaged position.

It is noted that the lever pin 30 includes a partially spherical pivot end 50 that is received in a concave spherical bore portion 32*a* of bore 32 as best illustrated in FIG. 5. As shown in FIGS. 4 and 5, the push-button 20 includes a pivot arm 52 which is received under a shoulder 54 of the cover 22 in order to pivotally support the push-button 20 to the cover 22.

Figure 6:
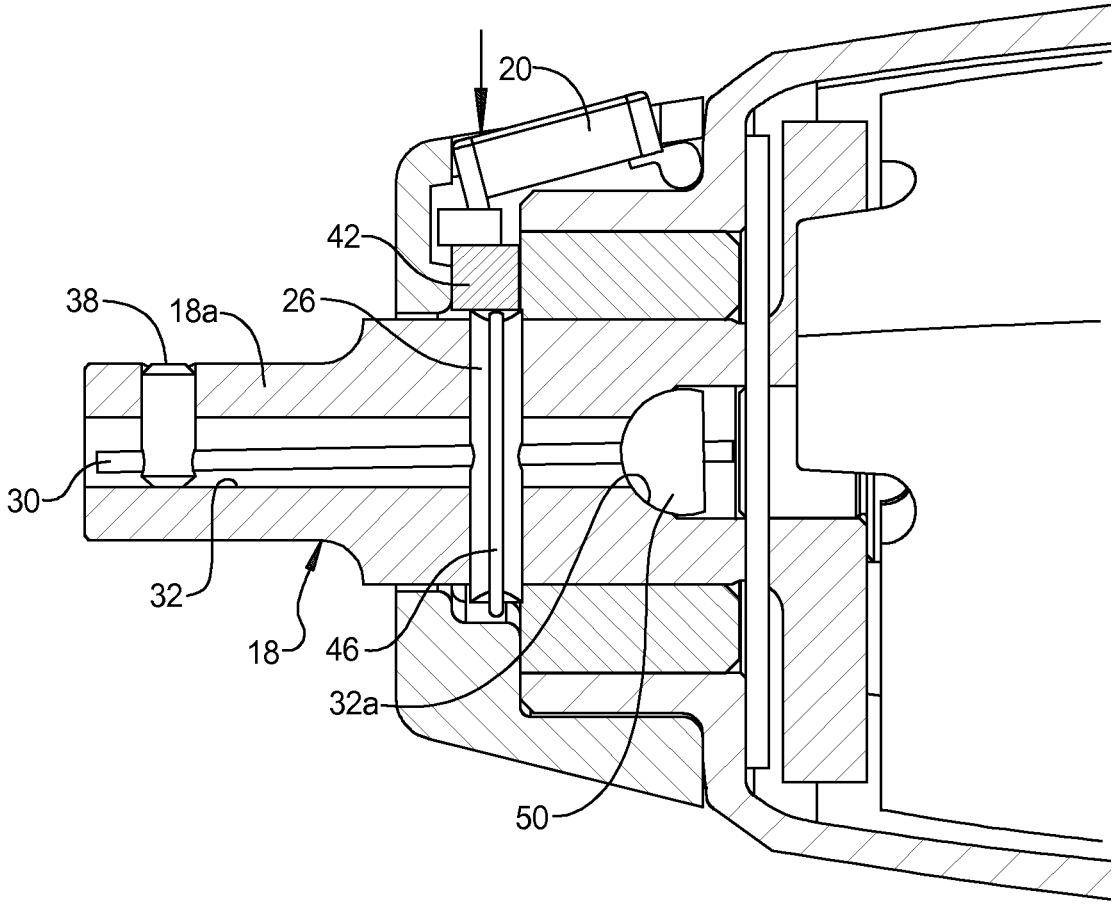
FIG. 6 is a cross-sectional view of the push button socket release mechanism of FIG. 1, shown in the release position.

As illustrated in FIG. 6, as the push-button 20 is pressed, the cam actuator 42 is pressed downward (as viewed in FIG. 6) against the force of the springs 44 and engages the actuator pin 26. As the actuator pin 26 is pressed downward, the lever pin 30 pivots within the bore 32 about the spherical pivot end 50 thereby causing retainer pin 38 to be retracted in the bore 40 in the square socket drive 18*a*, to allow a socket wrench to be removed from the square socket drive 18*a*.

When the button 20 is released, the biasing force of the springs 44 will cause the cam actuator 42 to press upward on the button 20 while the hog ring 46 causes the actuator pin 26 to also move upward (as viewed in FIG. 6) thereby pivoting the lever pin 30 in the upward direction and moving the retainer pin 38 to its engaged position as illustrated in FIG. 5.

Figure 7:
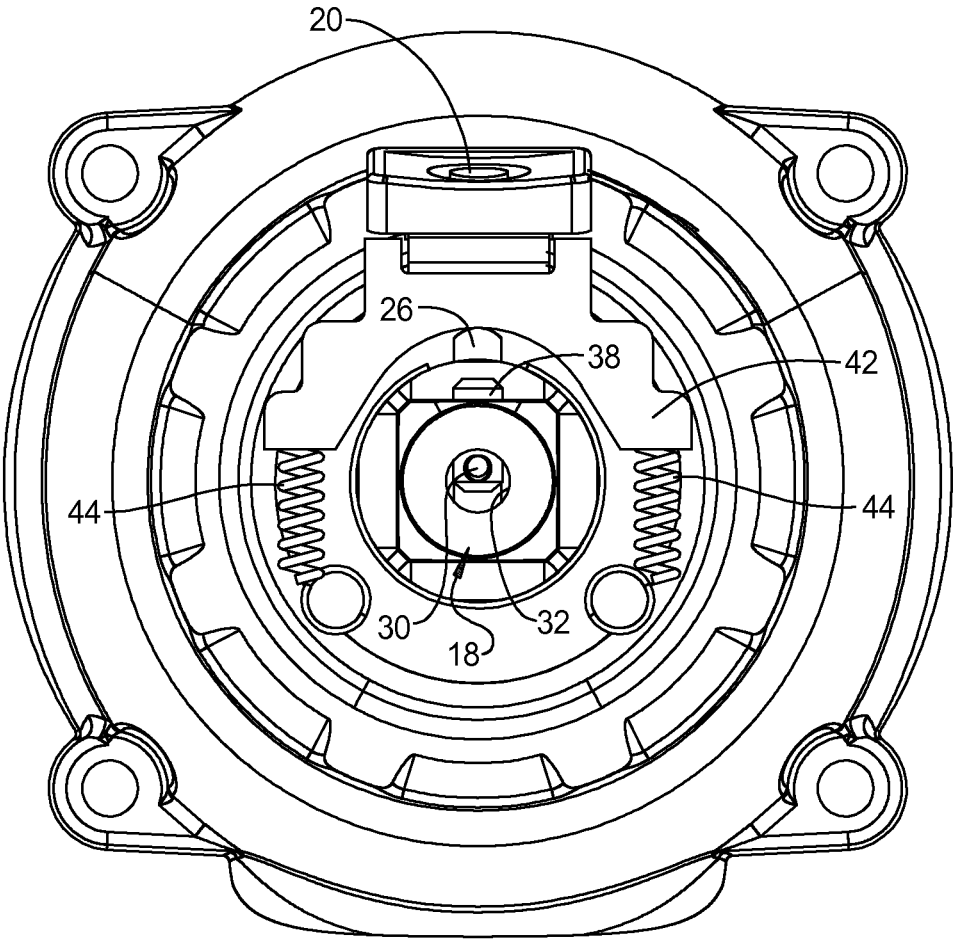
FIG. 7 is an end view of the push button socket release mechanism of FIG. 1, shown in the engaged position.
Figure 8:
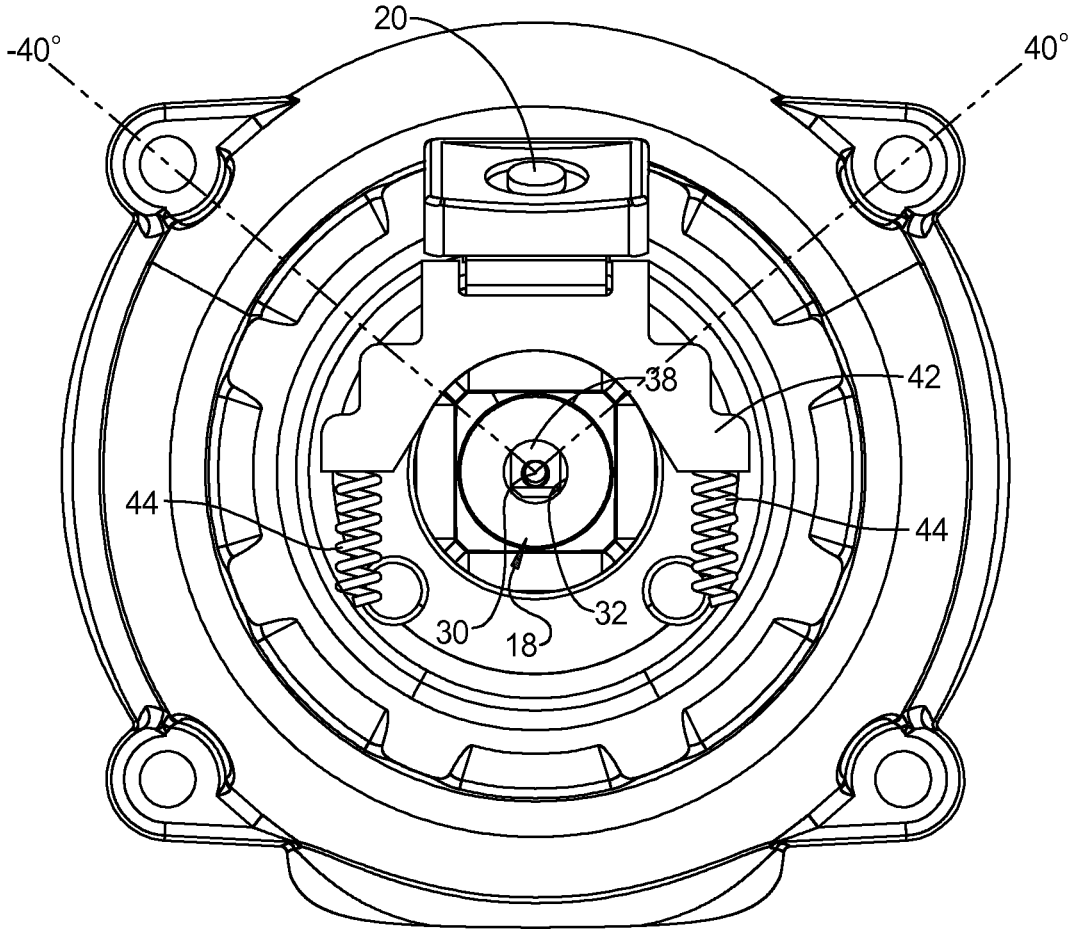
FIG. 8 is an end view of the push button socket release mechanism of FIG. 1, shown in the release position.

As illustrated in FIG. 7, an end view of the socket release mechanism is provided where the cam actuator 42 is spaced upward from the anvil 18. In this figure, the actuator pin 26 is in its extended position, as is the retainer pin 38. With reference to FIG. 8, the push-button 20 is pressed downward, causing the cam actuator 42 to move downward against the actuator pin 26, thereby pushing the actuator pin 26 down thereby pivoting lever pin 30 within the bore 32 so that the retainer pin 38 is retracted to the release position as shown.

Figure 9:
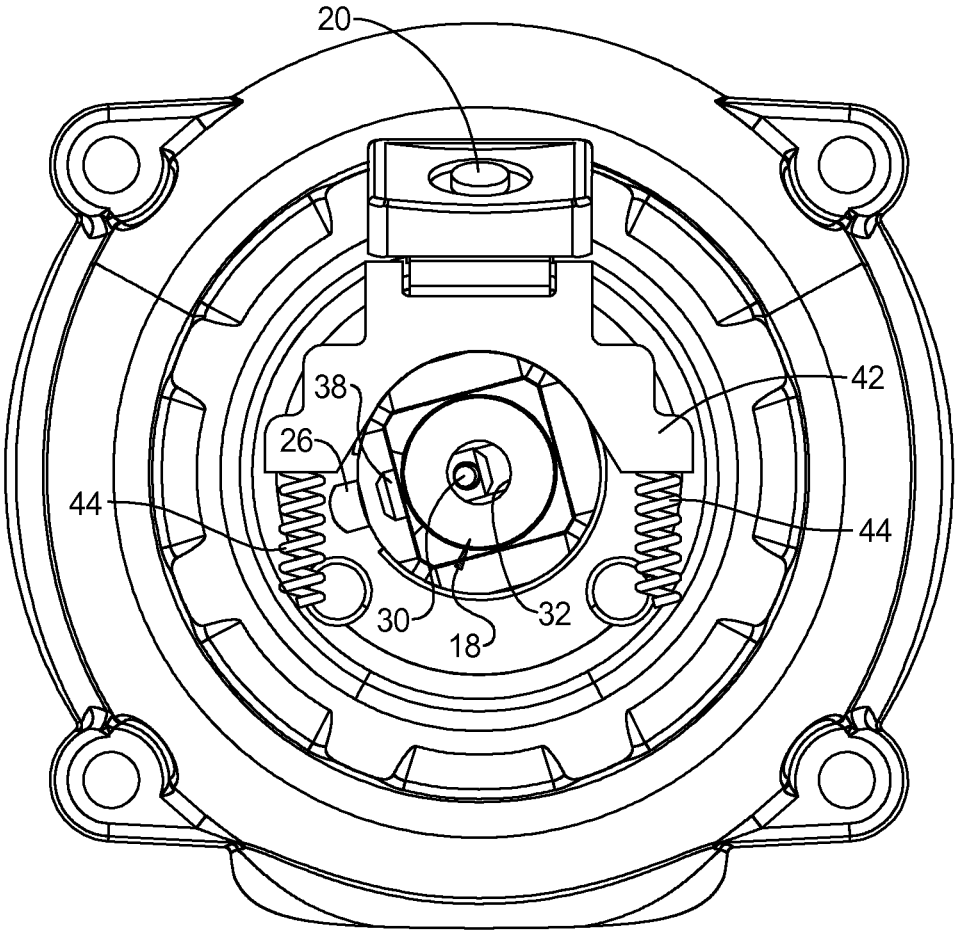
FIG. 9 is an end view of the push button socket release mechanism of FIG. 1, shown with the push button compressed, but the actuator pin in a position out of alignment with the socket release mechanism.

It should be noted that the push-button socket release mechanism 19 according to the embodiments shown in FIGS. 1-9 require that the actuator pin 26 be disposed within a range of plus or minus 40° from top dead center as illustrated in FIG. 8 in order to be properly engaged by the cam actuator 42 to move the retainer pin 38 to the disengaged or release position as shown. By way of illustration, FIG. 9 shows that when the anvil 18 is rotated to a position outside of the range of plus or minus 40° from top dead center the movement of the cam actuator 42 does not engage the actuator pin 26 and is therefore unable to disengage the retainer pin 38 from the socket wrench. Accordingly, the anvil can be provided with markings or other indicators to allow the user to recognize when the anvil 18 is properly oriented for release of the socket. The cam actuator 42 also has tapered lead-ins at each end and the actuator pin 26 is crowned so that if the button 20 is pushed while the anvil 18 is rotating the pin 26 will not crash into the ends of the cam actuator 42 rather will pass into engagement with the cam actuator 42 surface and be depressed by it.

Figure 10:
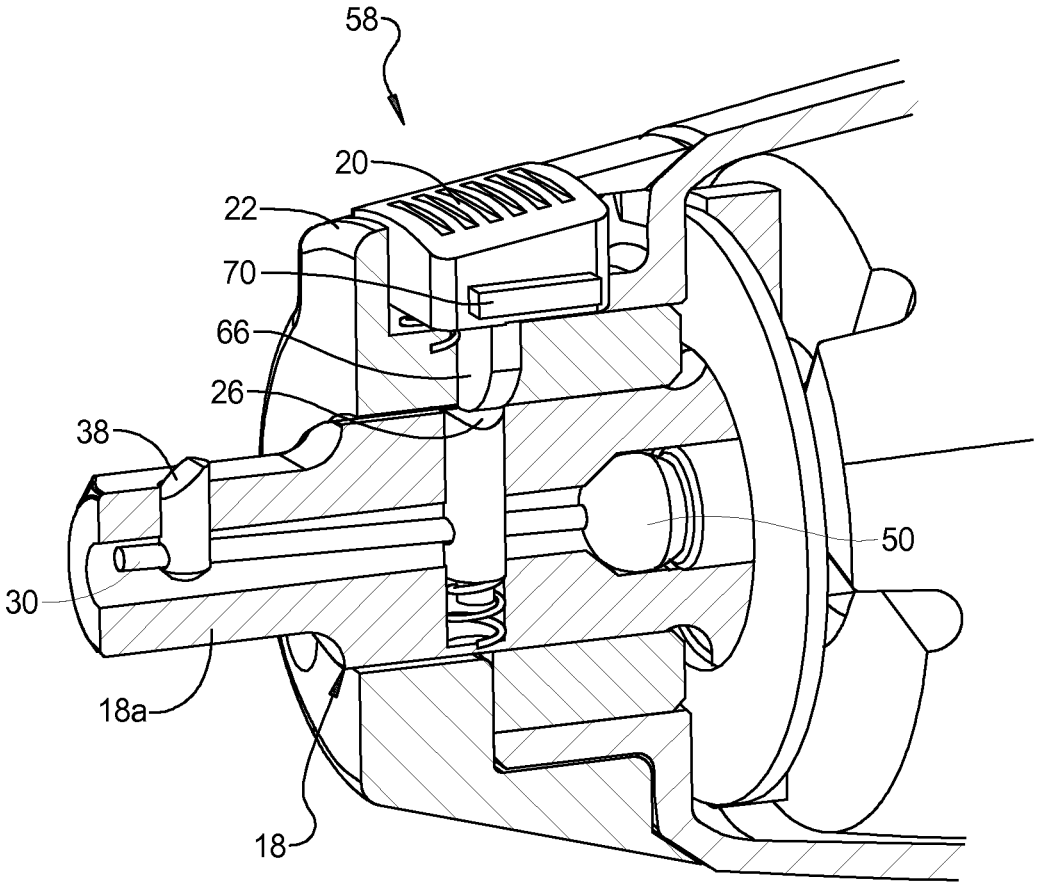
FIG. 10 is a partial cut-away perspective view of a push button socket release mechanism according to a second embodiment of the present disclosure with the cover cut away.
Figure 11:
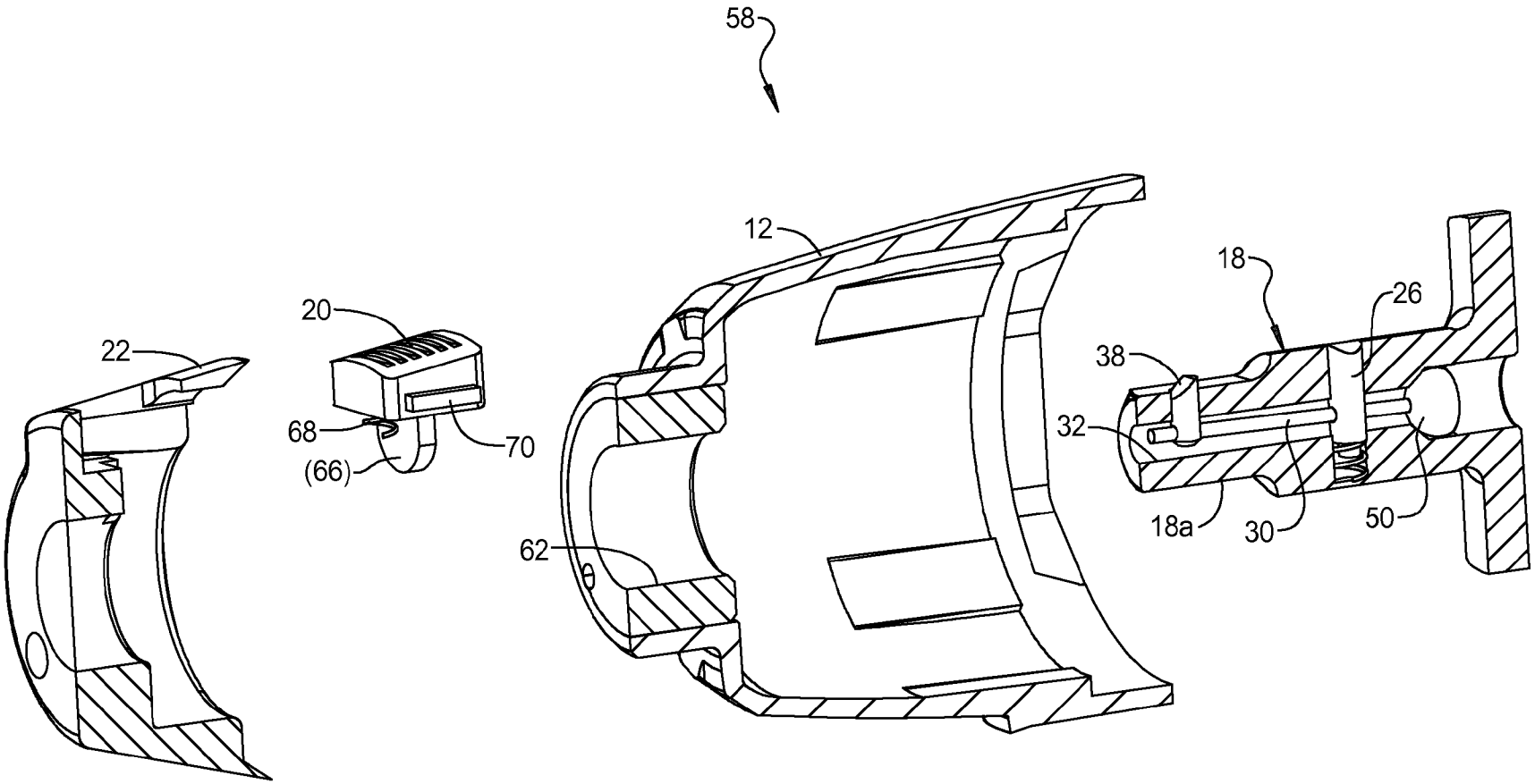
FIG. 11 is an exploded perspective view of the push button socket release mechanism of FIG. 10.
Figure 12:
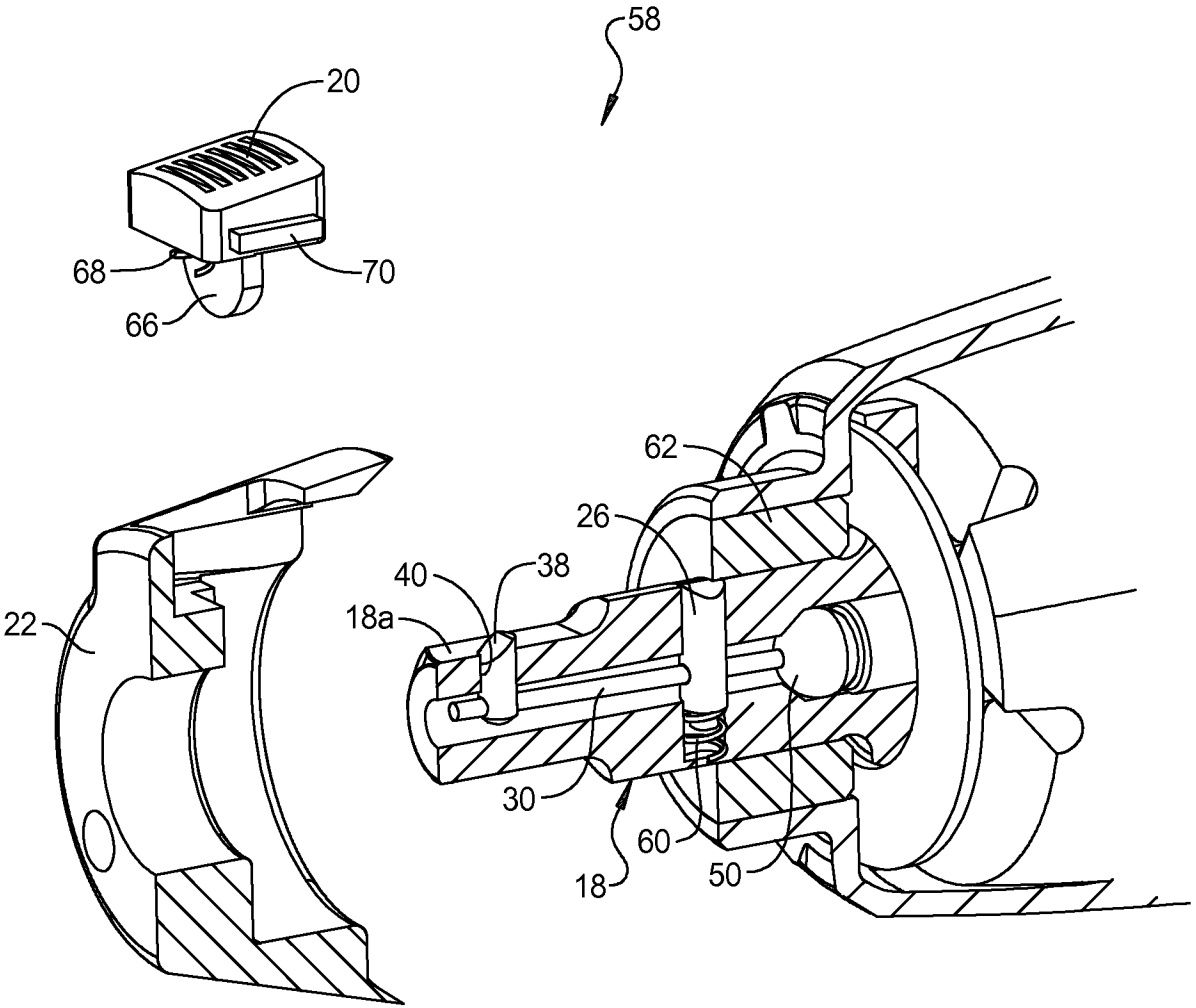
FIG. 12 is an partially assembled cut-away perspective view of the push button socket release mechanism of FIG. 10.

With reference to FIGS. 10-13, a second embodiment of the push-button socket release mechanism 58 will now be described. As shown in FIG. 10, the push-button socket release mechanism 58 according to this embodiment includes a push-button 20 that is used to disengaged a retainer pin 38 from a socket wrench that is received on the square socket drive 18*a* of the anvil 18. With reference to FIG. 12, the push-button socket release mechanism 58 according to this embodiment includes a lever pin 30, an actuator pin 26 and the retainer pin 38 all engaged in the same manner as described previously with respect to the first embodiment of FIGS. 1-9. However, a return spring 60 is provided directly against the actuator pin 26 within a transverse bore of the anvil 18. In this embodiment, the actuator pin 26 is slidably received against an annular collar 62.

The anvil shaft 18 is provided with a cylindrical divot 64 at the opening of the transverse bore 28, as best illustrated in FIG. 13. As illustrated in FIG. 10, when the anvil 18 is rotated to its top dead center position as illustrated in FIG. 10, the top of the actuator pin 26 becomes aligned with the stub 66 extending from the push-button 20 wherein the push-button 20 can be pressed downward causing the stub 66 to engage the top of the actuator pin 26 and to cause the actuator pin 26 to move against the biasing force of the return spring 60 so as to cause the lever pin 30 to pivot about its spherical end 50 thereby causing the retainer pin 38 to be retracted into the bore 40 in order to release a socket wrench received on the square drive socket 18*a* of the anvil 18. The stub 66 and divot 64 are so shaped to avoid grabbing or crashing if the button is pushed while the anvil is rotating. As shown in FIGS. 13*a* and 13*b*, the divot 64' and 64", respectively can be shaped as oblong or oval recesses to reduce stress in the anvil around the divot. Further, the retainer pin 38 has a beveled forward edge, and the lever pin 30 can be flexible. The lever pin 30 is inserted in a cross hole in the retainer pin 38 and keeps the beveled edge of retainer pin 38 oriented forward. The beveled forward edge as well as the flexible lever pin 30 allows for the socket to be easily pushed on and retained without the user being required to press a button or actuate the release mechanism. The design of the retention/release mechanism contained in the anvil is so configured as to hold together on its own as a sub-assembly. This will simplify assembly.

It is noted that an additional spring 68 (FIGS. 10-12) is provided for biasing the push-button 20 to its upward position. The push-button 20 includes a pair of side flanges 70 for supporting the push-button 20 within the cover 22. It should be understood that with the embodiment shown in FIGS. 10-13, the anvil 18 needs to be located so that the actuator pin 26 is at the top dead center position so as to be properly engaged by the push-button 20 in order to release the retainer pin 38 from the socket wrench.

With reference to FIGS. 14-19, an omnidirectional socket release mechanism 80 according to a third embodiment of the present disclosure will now be described. The omnidirectional socket release mechanism 80 includes a slide button 82 mounted to the housing 12 of the impact wrench 10 to allow the release of a socket wrench from the square socket drive 18*a*. As shown in the cross-section view of FIG. 15, the omnidirectional socket release mechanism 80 includes an actuator pin 84 having a chamfered head 86 that is biased by a spring 88 against a chamfered edge 90 of a cam ring 92.

As shown in FIG. 19, the cam surface 90 of the cam ring 92 can be formed at a single location along the inner surface of the cam ring 92. The configuration as shown, causes the cam ring 92 to rotate along with the anvil 18 due to the receipt of the actuator pin 84 therein. The cam ring 92 is able to rotate relative to a shift fork 94 which is attached to the slide button 82. The shift fork 94 is received in an annular groove 96 provided in the cam ring 92. The shift fork 94 is biased in a forward position by a spring 98, as best shown in FIG. 15. As the shift fork 94 and slide button 82 are in their forward position, the cam ring 92 is also in its forward position so that the actuator pin 84 is biased upward against the cam surface 90 of the cam ring 92.

When the slide button 82 is slid rearward as illustrated in FIG. 16, the shift fork 94 moves rearward against the biasing force of the spring 98 thereby causing the cam ring 92 to move in a rearward direction so that the cam surface 90 of the cam ring 92 presses inward on the cam surface 86 of the actuator pin 84. The actuator pin 84 then moves in a downward direction as illustrated in FIG. 16, thereby causing the lever pin 30 to pivot in a counter clockwise direction (as illustrated), thereby retracting the retainer pin 100 toward a release position to allow a socket wrench to be removed from the square drive socket 18*a* of the anvil 18. It is noted that the shift fork 94 and slide button 82 are disposed in a cover 102 which is mounted to the housing 12. With reference to FIGS. 15 and 16, it is noted that a thrust washer 104 may be disposed between the rear portion of the anvil shaft 18 and the housing 12. This embodiment also includes a beveled forward edge on the retainer pin 100 that is fixed by the lever pin 30 to provide a socket push-on feature. The release mechanism/anvil are also pre-assembled as a sub-assembly that simplifies the overall assembly. The assembly of parts that are the cover and interface 88, 92, 94, 102 are assembled as another drop-on sub-assembly thereby simplifying the overall assembly.

With reference to FIGS. 20-21*b*, a fourth embodiment of the socket release mechanism 110 will now be described. In the socket release mechanism 110, two slide buttons 112 are provided on opposite sides of the cover 114 to permit actuation of the release mechanism 110 to allow a socket wrench to be disengaged from the square socket drive 18*a*. With reference to FIGS. 21*a*-21*b*, the socket release mechanism 110 includes a cam ring 116 having an inner cam surface 118. The inner cam surface 118 is disposed against an outer cam surface 120 of an actuator pin 122 that is received on a lever pin 30 in the same manner as described above. The lever pin 30 engages a retainer pin 124 that extends from an aperture in the square socket drive 18*a* of the anvil 18. The actuator pin 122 is biased to an outward direction by a spring 126 that is received in a bore in the anvil shaft 18. The cam ring 116 is also biased in an axial direction by a spring 128 that biases the cam ring 116 in a forward axial direction away from the housing 12 of the impact wrench 10.

The slide buttons 112 are engaged with the cam ring 116 to cause the cam ring 116 to move in a rearward axial direction toward the housing 12. As the cam ring 116 is moved in the rearward direction, the cam surface 118 of the cam ring 116 causes the actuator pin 122 to move downward in the bore 130 in the anvil 18 against the biasing force of the spring 126. As the actuator pin 122 is moved downward, the lever pin 30 pivots in a counter clockwise direction as illustrated in FIG.

21*a*, causing the retainer pin 124 to be moved to a release position as illustrated in FIG. 21*b*. Once the retainer pin 124 is in the release position, the socket wrench can be removed from the square socket drive 18*a*.

Once the actuator buttons 112 are released, the spring 128 causes the cam ring 116 to move to its forward axial position and the spring 126 causes the actuator pin 122 to move upward causing the lever pin 30 to rotate in its clockwise direction so that the retainer pin 124 extends in an engaged position as illustrated in FIG. 21*a*. It should be noted that the retainer pin 124 has a beveled forward edge, that allows a socket wrench to be inserted on to the square drive socket 18*a* so that the retainer pin 124 moves inward as the socket wrench traverses across the beveled edge until the retainer pin is then allowed to pop back outward to engage a recess provided on an interior of the socket wrench. The retainer pin 124 has a beveled forward edge and is rotationally fixed by the lever pin 30, and the flexibility of the lever pin 30 provides a push-on feature.

With reference to FIGS. 22-26, an electro-mechanically actuated socket release mechanism 130 will now be described. The electro-mechanically actuated socket release mechanism 130 includes a forward coil 132 disposed in an annular steel cup 134 and a rearward coil 136 disposed in a second annular steel cup 138. A cam ring 140 is disposed between the forward and rearward coils 132, 136 and includes an integral permanent magnet ring 142. The cam ring 140 is provided with an annular inner cam surface 144, best shown in FIG. 25*a*, that engages an outer cam surface 146 of an actuator pin 148. In this embodiment, the actuator pin 148 is engaged with a lever pin 30 which is also engaged with a retainer pin 124. Thus, by actuation of coil 132, the permanent magnet 142 is attracted to the coil 132 in a forward position as illustrated in FIG. 25*a* wherein the retainer pin 124 is in an engaged position. As illustrated in FIG. 25*b*, when the second coil 136 is actuated and the first coil 132 is deactivated, the permanent magnet 142 is attracted to the second coil 136 thus causing the cam ring 140 to press the actuator pin 148 in an inward direction thereby causing pivoting of the lever pin 30 and movement of the retainer pin 124 to a release position as shown in FIG. 25*b*, wherein a socket wrench can be removed from the square socket drive 18*a* of the anvil 18.

The first and second coils 132, 136 are supported within the cover 150. The coils can be electrically connected to the tool battery or an alternative power source such as an A/C power source by a switch or contact that can be placed in multiple different locations on the tool, as illustrated in FIG. 26, as an interface to activate the socket release system.

The coils 132, 136 may be selectively energized to drive the permanent magnet and cam ring 140 to a forward or rearward position. Once in those positions the permanent magnet is attracted to the respective annular steel cup 134, 138. Thus only a pulse of energy is required to change states. Continuous power is not required to hold the cam ring in either position and this is advantageous for energy conservation on a cordless tool. Further, it should be understood that the electro-mechanically actuated socket release mechanism can be operated using a single coil and a spring for biasing the cam ring away from the coil during a non-activated state.

With reference to FIGS. 27 and 28, a socket release mechanism 160 according to a further embodiment of the present disclosure will now be described. The socket release mechanism 160 includes an actuating collar 162 which is moved in a forward direction (F) in order to cause release of the socket. In particular, the actuating collar 162 is biased in a rearward direction (R) by a spring (or multiple springs) 164 and the actuating collar 162 includes a forwardly facing annular inner cam surface 166. The cam surface 166 engages the top surface of an actuating pin 168 that is engaged by a self spring loaded lever pin 170. The lever pin 170 includes an integrally formed spring arm 172 that biases the actuating pin 168 and a retainer pin 174 to their extended position as illustrated in FIG. 27. The lever pin 170 is again, connected to a semi-spherical pivot end 176 which is received in a semi-spherical concave cavity 178 in the axial bore 180 of the anvil shaft 18.

When the actuating collar 162 is pulled in a forward direction, the actuating pin 168 is caused to move radially inward by the cam surface 166. As the actuating pin 168 is moved radially inward, the lever pin 170 moves against the biasing force of the integral spring arm 172 to cause the retaining pin 174 to move to a release position so that a socket wrench can be removed from the square drive socket 18*a*. When the actuating collar 162 is released, the spring 164 causes the actuating collar 162 to move to its rearward position, thus allowing the actuating pin 168 and retaining pin 174 to move to their extended positions. It should be noted that the lever pin 170 having the integral spring arm 172 can be interchanged with the use of the lever pin 30 and separate biasing spring acting directly on actuating pin 168.

With reference to FIG. 29, a further embodiment of a socket release mechanism 180 will now be described. The socket release mechanism 180 as shown in FIG. 29 includes an anvil shaft 18 having a hollow channel 182 there through. The anvil shaft 18 includes a square drive socket 18*a* at a front end thereof. The hollow channel 182 extends from the square drive socket 18*a* to a location rearward of the square drive socket 18*a*. The hollow channel 182 provides forward opening 184, which each respectively receive a forward and rearward detent ball 188, 190. The rearward opening may not necessarily require peening since the cam ring would retain the compliment of balls inside the anvil. The openings 184, 186 are peened on the edge to retain the balls 188, 190 therein. A plurality of intermediate balls 192 fill the hollow channel 182 between the forward and rearward detent balls 188, 190. The hollow channel 182 is provided with forward and rearward beveled (or curved) guide surfaces 194, 196 which engage the intermediate balls 192.

A cam ring 200 surrounds the rear opening 186 of the channel 182. The cam ring 200 includes a beveled cam surface 202 that engages the rear detent ball 190. The cam ring 200 can be biased by a spring and positioned so as to cause the rear detent ball 190 to be recessed in the channel 182 so as to cause the intermediate balls 192 to move along the channel in a forward axial direction thereby causing the forward detent ball 188 to protrude from the opening 184 in the square drive socket 18*a*. In this condition, the forward detent ball 188 can retain a wrench socket on the square drive socket 18*a*. In order to remove the wrench socket, the cam ring 200 can be pulled in a forward direction allowing the rear detent ball 190 to move to a radially outward position as illustrated in FIG. 29 thereby allowing the detent ball 188 in the square drive socket 18*a* to be moved to a retracted release position radially inward, thereby allowing the wrench socket to be removed.

FIG. 30 illustrates a similar ball-type socket release mechanism utilizing interior balls with an alternative rotary release collar 210. The rotary release collar 210 can be provided with a rearward cam surface 212 as illustrated in FIG. 31*a* that engages a cam follower surface 214 that is disposed against a rear of the anvil shaft 18. When the cam surfaces 212, 214 are "ramped up" relative to one another as illustrated in FIG. 31*a*, the anvil shaft 18 is pressed rearwardly against an input shaft 216 that includes a protruding portion 218 that extends into the interior chamber 220 disposed within the anvil shaft 18. The interior chamber 220 is filled with intermediate balls 192 similar to the prior embodiment which press against the detent ball 188 and hold the detent ball 188 in a engaged position protruding from a surface of the square drive socket 18*a*.

In order to release the socket release mechanism, the rotary collar 210 is rotated relative to the cam surface 214 to allow the cam surfaces 212, 214 to collapse as illustrated in FIG. 31*b* thereby allowing the anvil shaft 18 to move to a forward position relative to the input shaft 216 so that the balls 192 in the hollow chamber 220 are allowed to move rearwardly thereby allowing the detent ball 188 to move radially inward toward a release position as illustrated in FIG. 31*b*. The rotation of the locking collar 210 between an engaged and a release position, allow the quick and easy removal of a wrench socket from the anvil 18.

As an alternative embodiment as illustrated in FIGS. 32*a*-32*b*, the rotary collar can be replaced with slider tab 230 that allows a user to move the slider tab from a lock or engaged position, as illustrated in FIG. 32*a*, to the release or unlocked position as illustrated in FIG. 32*b* to thereby effect the relative movement between the cam surfaces 212, 214 as discussed with respect to the prior embodiment. The actuating mechanism of 212 and 214 may be adapted to actuate the cam rings of most all of the previously described embodiments.

With reference to FIGS. 33-34, an alternative socket release mechanism 240 will now be described. The socket release mechanism 240 includes an anvil 18 having an axially extending chamber 242 therein for receipt of a cam pin 244. The cam pin 244 is disposed against a bias spring 246 disposed in a rear portion of the chamber 242. A cross pin 248 is received in a transverse slot 250 extending through the anvil 18 and in communication with the chamber 242. The cross pin 248 is received in a rear aperture 252 in the cam pin 244. The forward end of the cam pin 244 is beveled and is disposed against a detent ball 254 that is received in a transverse aperture 256 provided in the square drive socket 18*a* of the anvil 18. The aperture 256 is peened on the edge to retain the ball 254 therein.

The spring 246 biases the cam pin 244 in a forward direction to cause the ball 254 to move toward a radially outwardly extending engaged position as illustrated in FIG. 33. A threaded stop member 258 can be inserted in a threaded end 260 of the chamber 242 in order to limit axial movement of the cam pin 242 and ball 254 therein. The cross pin 248 can be engaged by an annular collar or other member that can be actuated by the user to press the cross pin 248 to a rearward position of the slot 250 thereby causing rearward axial movement of the cam pin 244 that allows the detent ball 254 to move to a release position radially inward of the opening 256. In this release position, a socket wrench can be easily removed from the square drive socket 18*a* of the anvil 18. Upon release of the actuating collar, the spring 246 causes the cam pin 244 and cross pin 248 to move to their forward positions wherein the ball 254 is pressed radially outward to an engaged position as illustrated in FIG. 33.

With reference to FIGS. 35 and 36, the push-button socket release mechanism of FIGS. 10-13 is shown modified to include the lever pin 170 having an integrally formed spring arm 172 as discussed previously with reference to the embodiment of FIGS. 27 and 28. It is noted that the function and operation of the socket release mechanism of FIGS. 35 and 36 is essentially the same as the socket release mechanism disclosed in FIGS. 10-13 as discussed above. Accordingly, the drawings in FIGS. 35 and 36 have been numbered the same as the drawings in FIGS. 10-13 with the exception of the lever pin 170.

With reference to FIGS. 37*a* and 37*b*, a further alternative arrangement to the embodiment of FIGS. 10-13 is shown wherein the return spring 60 is eliminated and replaced with a hairpin spring 260 that engages a recessed groove 262 in the retainer pin 264. The hairpin spring 260 includes a pair of spring arms 266 that bias the retainer pin 264 in an upward direction as illustrated in FIG. 37*a*. In this embodiment, the actuator pin 26 is connected to the lever pin 30 and the lever pin 30 is connected to the retainer pin 264 in the same manner as described previously with reference to the embodiment of FIGS. 10-13. The spring arms 266 of the hairpin spring 260 act to bias the retainer pin 264 to its engaged position as illustrated in FIG. 37*a* when the push-button 20 is released. It should be understood that the use of the hairpin spring 260 can be utilized with numerous different embodiments of the present application and is not limited to use with the specific push-button actuator as disclosed herein.

With reference to FIGS. 38 and 39, a modified lever pin 270 is shown including a flexible elastomeric plug 272 in place of the semi-spherical head 50 shown on previous lever pin designs 30. It should be understood that the flexible elastomeric plug 272 (shown in FIG. 39) allows the lever pin 270 to pivot in the same or similar manner as the spherical pivot 50 of the previous lever pin design 30. Accordingly, the modified lever pin 270 and flexible elastomeric plug 272 can be utilized in various of the embodiments disclosed herein.

With reference to FIGS. 40 and 41, an alternative arrangement of the lever pin 280 is shown. In the embodiment shown in FIGS. 40 and 41, the lever pin 280 is generally L-shaped including a relatively long arm portion 282 and a relatively short arm portion 284 which can be angularly disposed relative to one another wherein the short arm portion 284 can be perpendicular to the long arm portion 282 or other angles can be provided. The rear portion of the anvil shaft 18 can be provided with a slot 288 that extends radially outward from the axially extending chamber 289 and receives the short leg portion 284 of the modified lever pin 280. The short arm portion 284 can be pressed into the slot 288 and staked in place as illustrated in FIG. 41. The staking process can include peening the edges of the slot 288 to secure the short leg 284 in the slot 288. In this embodiment, the lever pin 280 can be elastically deformed to provide the necessary spring force for returning the actuator pin 26 and retainer pin 38 to their engaged position. Thus, the use of the modified lever pin 280 eliminates the necessity for secondary springs such as the hog ring 46 shown in FIG. 4, return spring 60 as shown in FIG. 12, return spring 88 as shown in FIG. 15, return spring 126 as shown in FIG. 21, the spring arm 172 as shown in FIG. 27 and the hairpin spring 260 as shown in FIG. 37*a*.

With reference to FIG. 42, the modified lever pin 280 is shown with its short leg 284 inserted into a hole 287 in the interior wall of the anvil 18 as an alternative to the slot 288 as shown in FIGS. 40 and 41.

With reference to FIG. 43, an alternative method of actuating the lever pin 30 is shown wherein the semi-spherical pivot 50 is non-rotatably indexed relative to the anvil 18 and an actuating head 290 is utilized for pushing on and pivoting the semi-spherical pivot 50 to cause the lever pin 30 to move against the biasing force of a return spring 292 in order to cause the retainer pin 38 to move to a release position to allow a socket wrench to be removed from the square drive socket 18*a* of the anvil 18. The actuating head 290 can take on many forms and preferably is capable of transmitting an axial motion into a rotary motion relative to the semi-spherical pivot 50 of the lever pin 30.

With reference to FIGS. 44 and 45, the lever pin 300 is shown modified to include a pivot axis 302 which is mounted within the axially extending channel provided in the anvil shaft 18. The modified lever pin 300 includes an angled hook portion 304 at its proximal end and is attached to the retainer pin 38 at its distal end 306. An actuator head 310 is provided for axial movement to engage the hook-shaped proximal end 304 of the lever pin 300 in order to cause the lever pin 300 to pivot about its pivot axis 302 thereby withdrawing the retainer pin 38 toward a release position that would allow a socket wrench to be removed from the square socket drive 18*a* of the anvil 18. A return spring 312 can be provided within the anvil 18 for biasing the retainer pin 38 to its engaged, extending position as illustrated in FIG. 45. It is noted that the pivot axis 302 can be inserted in a transverse bore or aperture in the anvil shaft 18. Furthermore, the actuating head 310 can extend through an opening in the impact mechanism.

By way of example, as illustrated in FIG. 46, a push-button interface 320 can be provided on the rear surface of the impact wrench housing 12 and can be engaged with a motor sub assembly 322 which can be slidably supported within the housing 12 and biased in a rearward direction by a spring 324. The motor sub assembly 322 provides a drive shaft 326 that provides drive torque through a planetary gear train 328 that drives the impact mechanism 24. The motor drive shaft 326 can be aligned with a push rod 330 that is moved axially when the push-button interface 320 is depressed, causing the motor sub assembly 322 to move axially to cause the push rod 330 to move to its actuating position. The actuation device of FIGS. 46 and 47 can be utilized with the socket release mechanisms disclosed in FIG. 43 as well as FIGS. 44 and 45. FIG. 47 illustrates the push-button interface 320 pressed forward to cause forward movement of the motor sub assembly 322 as well as the push rod 330 for engagement with the socket release mechanism 332. The engagement of the push-button interface 320 thereby causes the retainer pin 38 to move to its release position to allow a socket wrench to be removed from the square drive socket 18*a* of the anvil shaft 18.

With reference to FIGS. 48-52, a push-button socket release mechanism 400 utilizing a cam pin will now be described. The socket release mechanism 400 includes a push-button 402 for actuating the release mechanism 400. With reference to cross-sectional view of FIG. 49, the push-button 402 is designed to engage an actuator pin 404, when the actuator pin 404 is located at the top dead center position. The actuator pin 404 includes a cam surface 406 at an inner end thereof that engages a corresponding cam surface 408 on a cam pin 410. The cam pin 410 is biased by a spring 412 toward a rearward position of an axially extending channel 414 provided within the anvil shaft 18. A retainer pin 416 is received in a transverse bore 418 in the anvil shaft 18 that communicates with the axial channel 414. The retainer pin 416 includes an interior cam surface 420 that engages a corresponding cam surface 422 provided on a distal end of the cam pin 410.

As the cam pin 410 is moved in an axial direction away from the housing 12 of the impact wrench, the cam surface 422 of the cam pin 410 rides up the cam surface 420 of the retainer pin 416 causing the retainer pin 416 to retract inward to a release position. In the release position, a socket wrench can be easily from the square drive socket 18*a* of the anvil shaft 18. The retainer pin 416 can be biased by a spring 424 to its engaged position. The spring 424 can be received in a recessed bore 426 on an opposite side of the axial channel 414 from the bore 418. The push button 402 can be biased by a return spring 430 to its unactivated state.

As illustrated in FIG. 50, push-button 402 is shown in its depressed position with the actuator pin 404 pressed downward thereby causing forward axial movement of the cam pin 410. The forward axial movement of the cam pin 410 causes the cam surface 422 to slide upward along the cam surface 420 of the retainer 416 to cause the retainer pin 416 to move against the biasing force of the spring 424 to its retracted release position.

FIG. 51*a* illustrates the anvil sub assembly with the anvil shaft 18 having the actuator pin 404, cam pin 410, return spring 412, retainer pin 416 and return spring 424 all shown in exploded view. FIG. 51*b* shows the retainer pin 416 and the return spring 424 assembled to the anvil shaft 18 and insertion of the cam pin 410 and return spring 412 within the axial channel 414 and the insertion of the actuator pin 404 into the anvil shaft 18. This embodiment also provides for a self-contained/"self-retained" anvil sub-assembly. This allows for the anvils to be assembled and held together on its own during the assembly process.

With the anvil sub assembly preassembled as illustrated in FIG. 51*b*, the assembly of the socket release mechanism is illustrated with reference to FIGS. 52*a*-52*e*. As illustrated in FIG. 52*b*, the housing portion 12 includes an aperture 436 for receiving a push-pin 438 therein. The push-pin 438 is connected to the push-button 402 which is mounted to a cover assembly 440. The anvil sub assembly is inserted through an aperture in the housing portion 12 and is supported therein by bearings 444. The push-pin 438 is inserted through the aperture 436 in the housing portion 12 and is received against the actuator pin 404. With reference to FIG. 52*a*, a head portion 446 of the push-pin 438 is inserted into a T-slot 448 provided in the push-button 402, as the cover sub assembly 440 is installed on the housing 12.

With reference to FIGS. 53 and 54, an exemplary push-button quick release accessory 500 is shown for attachment to an existing drive tool. The accessory 500 includes a body 502 having a first end 502*a* defining a hollow cavity 504 adapted to receive a polygonal head of a drive tool such as a socket drive that can be part of a hand tool or a motorized drive tool. At a second end 502*b* of the body 502, a square or other polygonal shaped drive socket 505 is provided for receiving a drive socket thereon. A push-button 506 can be mounted to a mid-portion 502*c* of the body 502. The push-button 506 can be attached to an actuator pin 508 that is received in a transverse bore 510 in the body 502. The actuator pin 508 can be engaged by a lever pin 512 that is pivotally received in an axial bore or aperture 514 in the body 502. The lever pin 512 can include a semi-spherical base 516 that is received against a corresponding semi-spherical surface 518 within the bore or aperture 514. The lever pin 512 further engages a retainer pin 520 that is retractably received in a transverse bore 522 in the drive socket 505. A spring 524 is disposed in the transverse bore 510 to bias the push-button 506 and the retainer pin 520 to their extended position, as illustrated.

In operation, the push-button 506 can be depressed to cause the lever pin 512 to pivot and cause the retainer pin 520 to be retracted to allow the release of a socket. The forward edge 526 of the retainer pin 520 can be tapered and the lever pin 512 can be flexible to allow a socket to be easily pressed onto the drive socket 505, thereby causing the retainer pin 520 to be pressed inward and the lever pin to either flex or pivot to accommodate the movement of the retainer pin 520. Once the retainer pin is aligned with a corresponding interior ledge on the socket, the retainer pin is biased to pop outward to retain the socket in place. A press-in retainer 530 can be received in the cavity 504 to retain the lever pin 512 in place.

The push-button quick release accessory 500 can be installed on an existing drive tool that does not have a quick release capability to thereby provide a retrofittable system for providing a quick release push-button system. The first end

502*a* of the body 502 can include an aperture 532 to facilitate fixing the attachment of the accessory 500 to an existing drive socket of a tool.

It should be understood that in the present disclosure, numerous features have been shown and described. It should also be understood that many of the components disclosed herein can be interchanged with other embodiments. For example, various actuators have been disclosed which can be utilized with various other mechanisms for causing a retainer pin to move from an engaged position to a release position. In addition, various spring mechanisms, lever pins, cam pins and ball mechanisms have been shown for returning the components to their unactivated state. These various mechanisms can be interchangeably used amongst various of the embodiments disclosed herein. Although the present disclosure illustrates the release mechanisms as part of an impact wrench, the release mechanisms can be utilized on other motorized and hand tools having both polygonal and round tool interfaces and should not be narrowly construed to apply only to impact wrenches. In particular, the present designs can be utilized on socketed and non-socketed hand tools and on sanding or grinding tools as well as non-impact-type socketed and non-socketed drivers.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power tool, comprising:

a housing including a handle;

a rotating shaft supported by and rotatable relative to said housing;

a socket retention device coupled to said rotating shaft for securing a socket to said rotating shaft; and a socket release mechanism including an actuator mounted to said housing so that the actuator does not rotate together with the rotating shaft, the socket release mechanism operable to disengage said socket retention device from said socket to allow said socket to be removed from said rotating shaft, wherein said socket retention device includes a movable retainer projection disposed in a head of said rotating shaft transverse to an axis of the rotating shaft, and said socket release mechanism includes a lever engaging said retainer projection and operable by said actuator to move said retainer projection out of engagement with said socket, wherein said lever is disposed inside the rotating shaft and includes a pivot received in a cavity in said rotating shaft.

2. The power tool according to claim 1, wherein said lever comprises a flexible portion.

3. The power tool according to claim 1, wherein said socket release mechanism includes an actuator pin engaging said lever and movable by activation of said actuator.

4. The power tool according to claim 3, wherein said socket release mechanism includes a cam actuator operable for engaging said actuator pin.

5. The power tool according to claim 1, wherein said socket release mechanism comprises a force transmission assembly that transfers force from the actuator to the socket retention device, the socket retention device and the force transmission assembly being disposed substantially inside of the rotating shaft, and the actuator being disposed substantially outside of the rotating shaft.

6. The power tool according to claim 1, wherein said actuator includes a movable switch mounted to said housing.

7. The power tool according to claim 6, wherein said movable switch is biased by a spring to a predetermined position.

8. The power tool according to claim 6, wherein said movable switch is movable in a direction parallel to, radial to, or circumferential to an axis of rotation of said rotatable shaft by a user to engage said socket retention device to disengage said socket retention device from said socket.

9. The power tool according to claim 6, wherein said movable switch comprises one of a movable lever, a push button, a sliding switch, and a movable collar.

10. The power tool according to claim 1, wherein said actuator includes an electro-mechanical actuator.

11. The power tool according to claim 10, wherein said actuator further includes a cam surface coupled to the electro-mechanical actuator and said socket release mechanism includes a mechanical linkage that engages said socket retention device and the cam surface for moving said socket retention device to a disengaged position when said electro-mechanical actuator causes movement of the cam surface.

12. The power tool according to claim 1, wherein said lever includes a semi spherical pivot received in a semi spherical cavity in said rotating shaft.

13. The power tool according to claim 1, wherein said lever includes an actuating pin received thereon and extending through a transverse bore in said rotating shaft.

14. The power tool according to claim 13, further comprising a spring disposed against said actuating pin.

15. The power tool according to claim 1, wherein said socket release mechanism includes a cam pin axially slidable in an axially extending opening in said rotating shaft.

16. The power tool according to claim 1, wherein said rotating shaft includes a polygonal head and said socket retention device includes one of a pin and a ball extending through a window opening in a side of said polygonal head.

17. A powered wrench comprising:

a housing;

a motor disposed in the housing;

a rotatable output shaft supported by and rotatable relative to the housing and coupled to the motor via a transmission so that rotation of the motor causes rotation of the output shaft, the rotatable output shaft having a distal end portion for receiving a socket accessory;

a socket retention projection coupled to said rotating shaft and movable between a first position where the socket retention projection projects from an outer surface of the distal end portion to secure a socket accessory to the rotating shaft, and a second position where the socket retention projection is retracted toward the outer surface to release the socket accessory from the rotating shaft;

an actuator movable by a user and coupled to the housing so that the actuator does not rotate together with the rotatable shaft; and a lever coupled to the actuator and to the socket retention projection, such that movement of the actuator by the user causes the socket retention projection to move between the first position and the second position, wherein the lever is disposed inside the rotatable output shaft and includes a pivot received in a cavity in the rotatable output shaft.

18. A socket retention mechanism for use with a fastening tool comprising:

a rotatable shaft having a first end and a second end, the first end supportable by a fastening tool for being driven in rotation about an axis of the shaft;

a socket retention projection selectively projecting from the second end of the rotatable shaft for securing a socket to the second end of the rotatable shaft; and a socket release mechanism including an actuator and a lever extending along the axis and engaging the socket retention projection, the lever operable by the actuator to move the socket retention projection out of engagement with a socket secured to the second end of the shaft, the lever including a semi spherical pivot received in a semi spherical cavity positioned along the axis in the shaft.

19. The socket retention mechanism of claim 18, wherein the fastening tool comprises a power tool having a housing and the rotatable shaft is rotatable relative to the housing.

20. The socket retention mechanism of claim 19, wherein the actuator is disposed on the housing of the power tool so that the actuator does not rotate together with the shaft.

* * * * *